US005826285A

United States Patent [19]

Mariol et al.

[11] Patent Number: 5,826,285

[45] Date of Patent: Oct. 27, 1998

[54] PLAY YARD

[75] Inventors: John V. Mariol, Cincinnati, Ohio; Thomas J. Welsh, Jr., Naperville, Ill.

[73] Assignee: Kolcraft Enterprises, Inc., Chicago, Ill.

[21] Appl. No.: 711,541

[22] Filed: Sep. 10, 1996

[51] Int. Cl.[6] ..... A47D 7/00; A47D 13/06

[52] U.S. Cl. ..... 5/99.1; 5/93.1

[58] Field of Search ..... 5/93.1, 93.2, 99.1

[56] References Cited

U.S. PATENT DOCUMENTS

| | | | |
|---|---|---|---|
| Re. 25,195 | 7/1962 | Hamilton | 5/98 |
| D. 145,052 | 6/1946 | Boisselier | D34/5 |
| D. 158,030 | 4/1950 | Wagner | D5/5 |
| D. 186,358 | 10/1959 | Fulton | D5/5 |
| D. 192,072 | 1/1962 | Hamilton | D5/5 |
| D. 193,326 | 8/1962 | Hamilton | D5/5 |
| D. 197,551 | 2/1964 | Choy et al. | D5/5 |
| D. 244,890 | 7/1977 | Adams | D6/13 |
| D. 257,299 | 10/1980 | Cone | D6/13 |
| D. 281,745 | 12/1985 | Pandorf et al. | D6/390 |
| D. 304,523 | 11/1989 | Dillner et al. | D6/391 |
| D. 316,339 | 4/1991 | Taylor | D6/391 |
| D. 323,589 | 2/1992 | Mariol | D6/331 |
| D. 339,922 | 10/1993 | Williams | D6/331 |
| D. 366,978 | 2/1996 | Mariol | D6/491 |
| 540,863 | 6/1895 | Lawson . | |
| 1,211,730 | 1/1917 | Lucas . | |
| 1,374,333 | 4/1921 | Stotler et al. . | |
| 1,413,068 | 4/1922 | Stotler et al. . | |
| 1,630,941 | 5/1927 | Hood . | |
| 1,779,060 | 10/1930 | Choate . | |
| 1,782,217 | 11/1930 | Stoddard . | |
| 1,975,332 | 10/1934 | Rehkopf | 5/98 |
| 2,287,907 | 6/1942 | Schettler, Jr. | 5/98 |
| 2,308,608 | 1/1943 | Kennedy | 5/99.1 |
| 2,464,866 | 3/1949 | Holtz | 5/98 |
| 2,486,054 | 10/1949 | Morse | 5/99 |
| 2,486,067 | 10/1949 | Schroeder | 5/99 |
| 2,490,296 | 12/1949 | Fournier | 5/99 |
| 2,491,036 | 12/1949 | Dodge | 5/99 |
| 2,498,203 | 2/1950 | Fischer | 5/98 |
| 2,523,422 | 9/1950 | Dunn | 5/99 |
| 2,561,637 | 7/1951 | Rex | 5/99 |
| 2,563,446 | 8/1951 | Abel | 5/99 |
| 2,569,937 | 10/1951 | Lindgren | 5/99 |
| 2,574,079 | 11/1951 | White | 5/99 |
| 2,590,315 | 3/1952 | Hawley, Jr. | 5/98 |
| 2,607,052 | 8/1952 | Le Roy | 5/317 |
| 2,617,999 | 11/1952 | Mitchell | 5/99 |
| 2,624,054 | 1/1953 | Plant | 5/99 |
| 2,629,110 | 2/1953 | Fournier | 5/99 |
| 2,650,375 | 9/1953 | Serrell | 5/99 |
| 2,659,903 | 11/1953 | Hagelfeldt | 5/99 |
| 2,697,843 | 12/1954 | Skrmetti | 5/99 |
| 2,698,443 | 1/1955 | Ralick | 5/99 |
| 2,710,976 | 6/1955 | Martensen | 5/98 |
| 2,784,420 | 3/1957 | Moltane | 5/98 |
| 2,790,978 | 5/1957 | Tigrett | 5/98 |
| 2,809,382 | 10/1957 | Jackson | 5/99 |

(List continued on next page.)

FOREIGN PATENT DOCUMENTS

| | | |
|---|---|---|
| 0952496 | 8/1974 | Canada . |
| 1557841 | 7/1969 | France . |
| 2361846 | 3/1978 | France . |
| 043051 | 8/1887 | Germany . |
| 0481037 | 7/1929 | Germany . |

*Primary Examiner*—Brian K. Green
*Assistant Examiner*—Robert G. Santos
*Attorney, Agent, or Firm*—Marshall, O'Toole, Gerstein, Murray & Borun

[57] ABSTRACT

A play yard having a collapsible top assembly and a collapsible bottom assembly, each assembly connected to at least three spaced vertical posts. The bottom assembly includes a collapsible subassembly. Pairs of post connecting members pivotally connect each vertical post to the subassembly forming truss segments. The truss segments and subassembly form a truss. Stabilizer feet are connected to the subassembly. The truss vertical posts and stabilizer feet serve to support and stabilize the play yard when it is in an erected position.

27 Claims, 19 Drawing Sheets

U.S. PATENT DOCUMENTS

| | | | |
|---|---|---|---|
| 2,837,752 | 6/1958 | Wilkerson | 5/99 |
| 2,873,458 | 2/1959 | Adamson | 5/98 |
| 2,901,755 | 9/1959 | Wood, Jr. | 5/99 |
| 2,908,021 | 10/1959 | Fulton | 5/99 |
| 2,913,739 | 11/1959 | White | 5/99 |
| 2,922,169 | 1/1960 | Werner | 5/98 |
| 2,942,750 | 6/1960 | Neely | 220/6 |
| 2,958,084 | 11/1960 | Kenney | 5/99 |
| 2,992,441 | 7/1961 | Landry | 5/99 |
| 3,018,493 | 1/1962 | Wittbrodt | 5/99 |
| 3,063,065 | 11/1962 | Shaw | 5/99 |
| 3,064,277 | 11/1962 | Gill | 5/98 |
| 3,091,249 | 5/1963 | O'Neil | 135/16 |
| 3,092,847 | 6/1963 | DePuy | 5/99 |
| 3,095,583 | 7/1963 | Golub et al. | 5/99 |
| 3,103,670 | 9/1963 | Landry | 5/99 |
| 3,127,620 | 4/1964 | Peterson | 5/99 |
| 3,158,876 | 12/1964 | Gottlieb | 5/99 |
| 3,165,760 | 1/1965 | Abajian | 5/97 |
| 3,173,155 | 3/1965 | Schweikert | 5/98 |
| 3,183,527 | 5/1965 | Turner | 5/98 |
| 3,183,528 | 5/1965 | Jacobs et al. | 5/99 |
| 3,206,772 | 9/1965 | Sarasin | 5/99 |
| 3,233,254 | 2/1966 | Golub et al. | 5/99 |
| 3,296,633 | 1/1967 | Rieger | 5/99 |
| 3,309,718 | 3/1967 | Sarasin | 5/98 |
| 3,430,273 | 3/1969 | Stillwaugh | 5/98 |
| 3,474,472 | 10/1969 | Hamilton, II | 5/98 |
| 3,605,139 | 9/1971 | Lorentz, Jr. | 5/99 R |
| 3,777,321 | 12/1973 | Hargett | 5/99 C |
| 3,789,439 | 2/1974 | Berg et al. | 5/99 C |
| 3,800,341 | 4/1974 | Davanzo | 5/99 R |
| 3,924,280 | 12/1975 | Vaiano | 5/98 R |
| 4,008,497 | 2/1977 | Badon | 4/171 |
| 4,008,499 | 2/1977 | Wren, Jr. et al. | 5/99 C |
| 4,044,411 | 8/1977 | Peterson | 5/99 A |
| 4,069,524 | 1/1978 | Carlo | 5/99 B |
| 4,070,716 | 1/1978 | Satt et al. | 5/99 C |
| 4,073,017 | 2/1978 | Stevens | 5/97 |
| 4,186,454 | 2/1980 | Cone | 5/99 R |
| 4,202,065 | 5/1980 | Sullivan | 5/99 A |
| 4,357,735 | 11/1982 | Saint et al. | 16/224 |
| 4,376,318 | 3/1983 | Cirillo | 5/99 C |
| 4,433,447 | 2/1984 | Mathou | 5/93 R |
| 4,455,697 | 6/1984 | Rovida | 5/99 C |
| 4,483,026 | 11/1984 | Kassai | 5/99 R |
| 4,493,120 | 1/1985 | Watts | 5/99 B |
| 4,499,619 | 2/1985 | Kassai | 5/99 A |
| 4,538,309 | 9/1985 | Gunter | 5/99 B |
| 4,561,138 | 12/1985 | Hwang | 5/102 |
| 4,573,224 | 3/1986 | Saint | 5/99 C |
| 4,599,832 | 7/1986 | Benton et al. | 52/118 |
| 4,635,305 | 1/1987 | Wyss | 5/99 R |
| 4,651,367 | 3/1987 | Osher et al. | 5/99 R |
| 4,669,138 | 6/1987 | Kassai | 5/99 C |
| 4,683,600 | 8/1987 | Beger | 5/99 C |
| 4,688,280 | 8/1987 | Kohus et al. | 5/99 R |
| 4,692,953 | 9/1987 | Fetters | 5/99 R |
| 4,703,525 | 11/1987 | Shamie | 5/99 R |
| 4,710,049 | 12/1987 | Chang | 403/23 |
| 4,739,527 | 4/1988 | Kohus et al. | 5/99 R |
| 4,750,223 | 6/1988 | D'Arcy et al. | 5/99 B |
| 4,811,437 | 3/1989 | Dillner et al. | 5/99 B |
| 4,815,153 | 3/1989 | Bleser et al. | 5/98 R |
| 4,819,285 | 4/1989 | Fetters | 5/99 R |
| 4,837,875 | 6/1989 | Shamie et al. | 5/99 C |
| 4,899,496 | 2/1990 | Chew, II | 5/98 R |
| 4,900,011 | 2/1990 | Nolet | 272/65 |
| 4,921,369 | 5/1990 | Chew, II et al. | 403/171 |
| 4,934,025 | 6/1990 | Mariol | 16/347 |
| 4,967,432 | 11/1990 | Kujawski et al. | 5/98 |
| 4,985,948 | 1/1991 | Mariol | 5/99.1 |
| 5,025,517 | 6/1991 | Johnson | 5/99.1 |
| 5,172,435 | 12/1992 | Griffin et al. | 5/95 |
| 5,193,234 | 3/1993 | Joaquin | 5/99.1 |
| 5,197,154 | 3/1993 | Shamie | 5/99.1 |
| 5,211,498 | 5/1993 | Huang | 403/102 |
| 5,212,841 | 5/1993 | Binnersley | 5/99.1 |
| 5,228,154 | 7/1993 | Brevi et al. | 5/99.1 |
| 5,239,714 | 8/1993 | Huang | 5/99.1 |
| 5,241,716 | 9/1993 | Kohus | 5/99.1 |
| 5,243,718 | 9/1993 | Shamie | 5/99.1 |
| 5,279,006 | 1/1994 | Teng | 5/99.1 |
| 5,293,656 | 3/1994 | Chan | 5/99.1 |
| 5,339,470 | 8/1994 | Shamie | 5/98.1 |
| 5,353,451 | 10/1994 | Hsiung | 5/99.1 |
| 5,358,220 | 10/1994 | Yu-Kuang | 256/25 |
| 5,363,521 | 11/1994 | Garland et al. | 5/99.1 |
| 5,367,725 | 11/1994 | Tsai | 5/99.1 |
| 5,377,368 | 1/1995 | Cheng | 5/991 |
| 5,381,570 | 1/1995 | Cheng | 5/99.1 |
| 5,446,931 | 9/1995 | Wei | 5/99.1 X |
| 5,504,951 | 4/1996 | Yeh | 5/99.1 |
| 5,553,336 | 9/1996 | Mariol | 5/93.1 |
| 5,664,267 | 9/1997 | Cheng | 5/99.1 |
| 5,706,533 | 1/1998 | Opheim et al. | 5/99.1 |

PLAY YARD

FIELD OF INVENTION

The invention disclosed herein relates generally to a play yard for infants and children and, more particularly, to an improved collapsible triangular-shaped play yard and a play yard having a collapsible bottom assembly comprising a truss formed of truss segments.

BACKGROUND OF THE INVENTION

Play yards are well known. Generally, they include a rectangular shape comprising four corner legs with structure for collapsing the top and bottom assemblies whereby the play yard can be folded in a compact position for storage and portability. While such play yards are satisfactory, it is desired to have a portable, collapsible play yard which is somewhat less cumbersome to collapse by reason of reducing the number of play yard sides. It is further desired to eliminate a play yard side and associated corner leg structure to reduce costs but at the same time the play yard must be relatively easy to erect, and, when erected to a use position, the play yard must be stable and support loads normally attendant with such devices.

SUMMARY OF THE INVENTION

Briefly, applicants' invention, as disclosed and claimed herein, is directed to obviating the above-described problems and achieving the desires for a play yard. The play yard of the present invention is relatively readily erected and collapsed while being easily portable. Additionally, the play yard employs a bottom assembly which includes a truss formed of truss elements sufficient to sustain vertical and horizontal loads normally associated with a play yard.

The play yard preferably employs three spaced vertical posts and collapsible top and bottom assemblies. The top assembly includes three rail assemblies. Each rail assembly includes a pair of rail members connected to a locking rail joint. Each rail member also is pivotally connected to a vertical post. The top assembly is adapted to collapse downwardly at the location of the locking rail joints.

The bottom assembly includes a collapsible triangular-shaped base subassembly preferably equilateral in shape. The three legs of the triangular-shaped subassembly each include a first leg portion and a second leg portion. One end of each leg portion is joined to a pedestal located at each of the apices of the triangular-shaped subassembly while the remaining ends of the leg portions are pivotally connected to a pivot joint designed to pivot a predetermined amount.

A load bearing stabilizer foot depends from each pedestal. Preferably, each stabilizer foot is spaced equidistant from adjacent vertical posts with a stabilizer foot being positioned away from the vertical central axis of the device and outside a plane which intersects the vertical axes of a pair of vertical posts adjacent the stabilizer foot. In the event the perimeters of the top and bottom assemblies vary, the stabilizer feet are located away from the vertical center axis of the play yard at a location which is at least on the edge of the maximum perimeter of the assemblies, but more preferably, outside the maximum perimeter.

Three pairs of post connecting members pivotally connect the vertical posts to the legs of the collapsible triangular-shaped subassembly. Each pair of post connecting members is connected by a universal joint to a leg of the triangular-shaped subassembly to form a triangular truss segment. The three triangular truss segments in conjunction with the triangular-shaped subassembly form a truss. The truss, in conjunction with the vertical posts and stabilizer feet, serve to provide a play yard, which, when erected, provides a substantially rigid and stable unit.

A plastic or cloth fabric panel assembly encloses the play yard. It includes three side panels draped from the sides of the rail members. The side panels, which, if desired, can be a mesh material, are joined along their respective bottom edges to a bottom fabric panel, the latter being adapted to seat on the truss segments. The bottom fabric panel is attached to the subassembly preferably at the location of the leg portion pivot connections. A removable, flexible base insert is adapted to be inserted in the play yard to create a floor when the play yard is in an erected, use position, the insert being supported by the truss including the post connecting members. The insert is maintained in position by the geometrical configuration of the vertical posts and stabilizer foot pedestals which serve to preclude the base insert from shifting from its normal inserted position.

The present invention provides a triangular-shaped play yard which provides the desired rigidity when erected to an in-use position while eliminating a side and corner structure from a conventional four-sided play yard. Moreover, the play yard of the present invention assures that due to the truss arrangement, the loads to be carried and supported by the play yard will be supported both by the stabilizer feet and vertical posts. The stabilizer feet are configured to be an integral part of the lower assembly serving to support vertical and horizontal loading and positioning of the base insert while precluding tip over of the play yard.

The truss segments which form the bottom assembly truss are designed to be spaced substantially away from the center of the play yard. In one embodiment, they serve, in conjunction with the vertical posts and stabilizer feet, to support all vertical loads acting on the play yard. Further, the location of the truss segments, in association with the triangular-shaped base subassembly, serve to position and maintain the vertical posts and stabilizer feet in a substantially rigid position when subjected to horizontal loads. The truss arrangement of the present invention is collapsible so that the play yard can be collapsed to form a compact, portable unit.

The divergent positioning of the pairs of post connecting members, which preferably angle outwardly approximately sixty degrees (60°) from each other, also provides structural support for the flexible, semi-rigid base insert with the support located contiguous to the perimeter of the base insert.

The play yard of the present invention can be readily erected to a use position or collapsed to a folded position. Moreover, the truss assembly of the present invention in conjunction with the stabilizer feet and vertical post can be utilized with multi-sided play yards. Other advantages will become apparent from a description of the drawings and detailed description.

DETAILED DESCRIPTION

Figure 1:
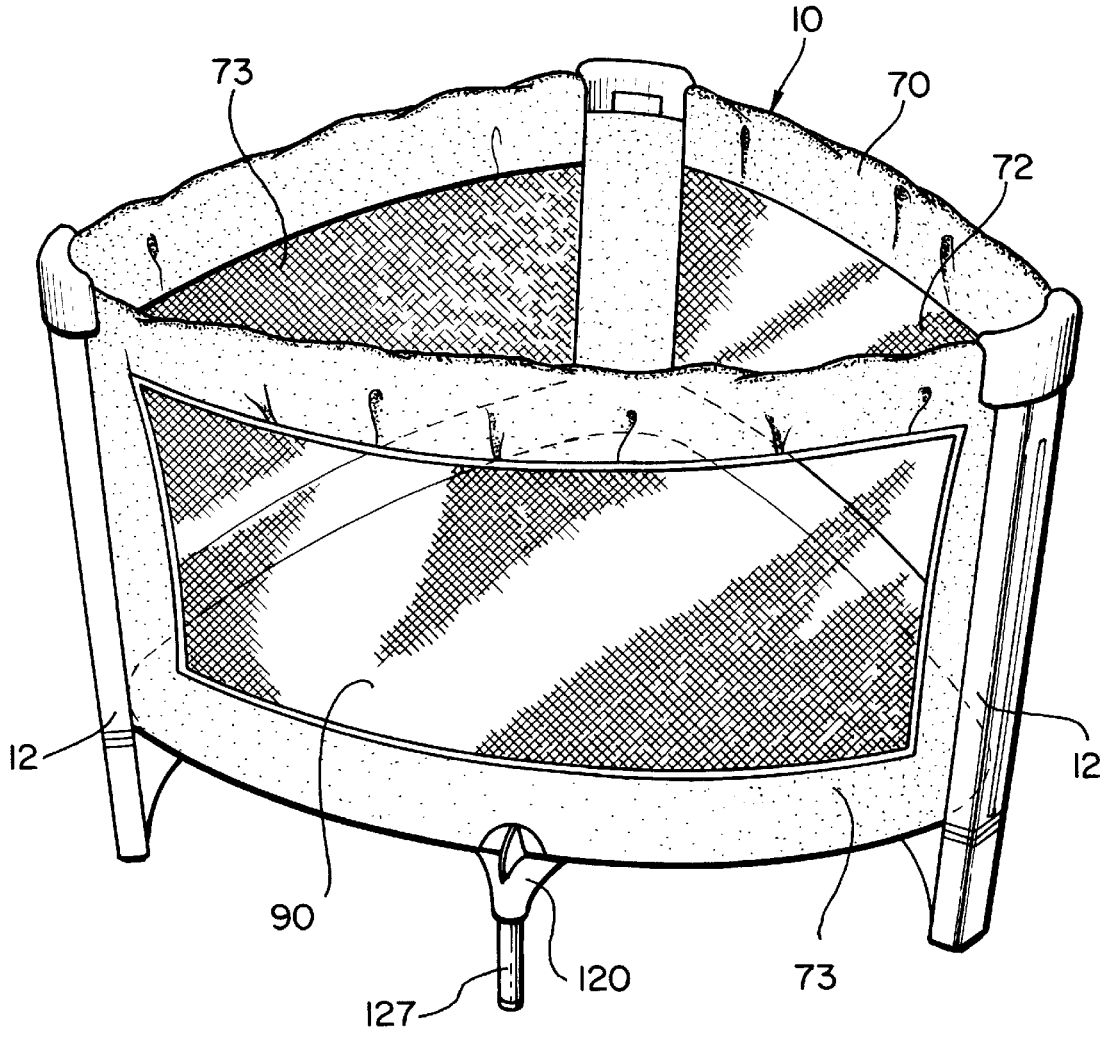
FIG. 1 shows a perspective view of a triangular-shaped play yard of the present invention with the play yard in an erected use position.
Figure 4:
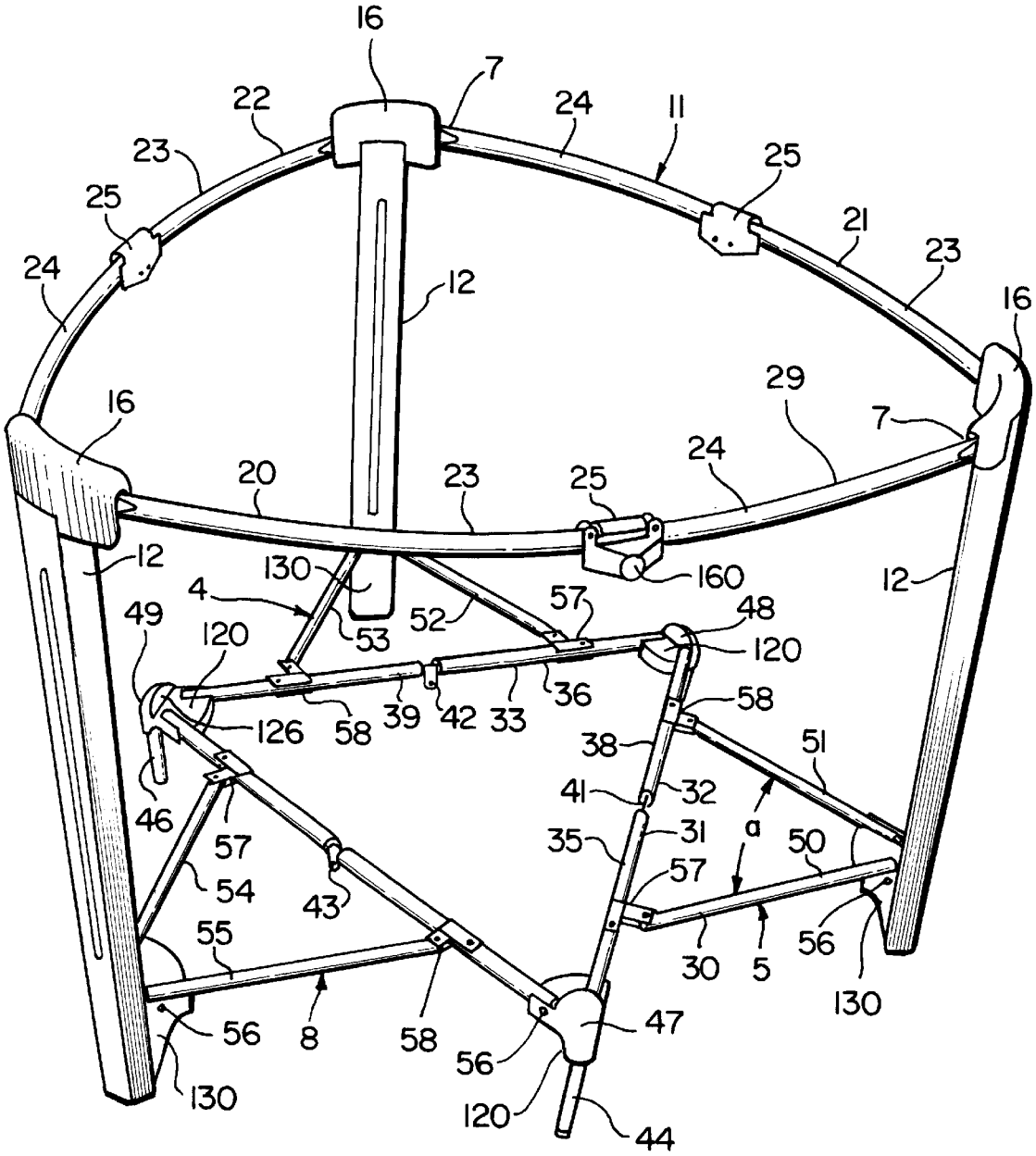
FIG. 4 shows a perspective view of the frame of the play yard of the present invention in the erected position.
Figure 5:
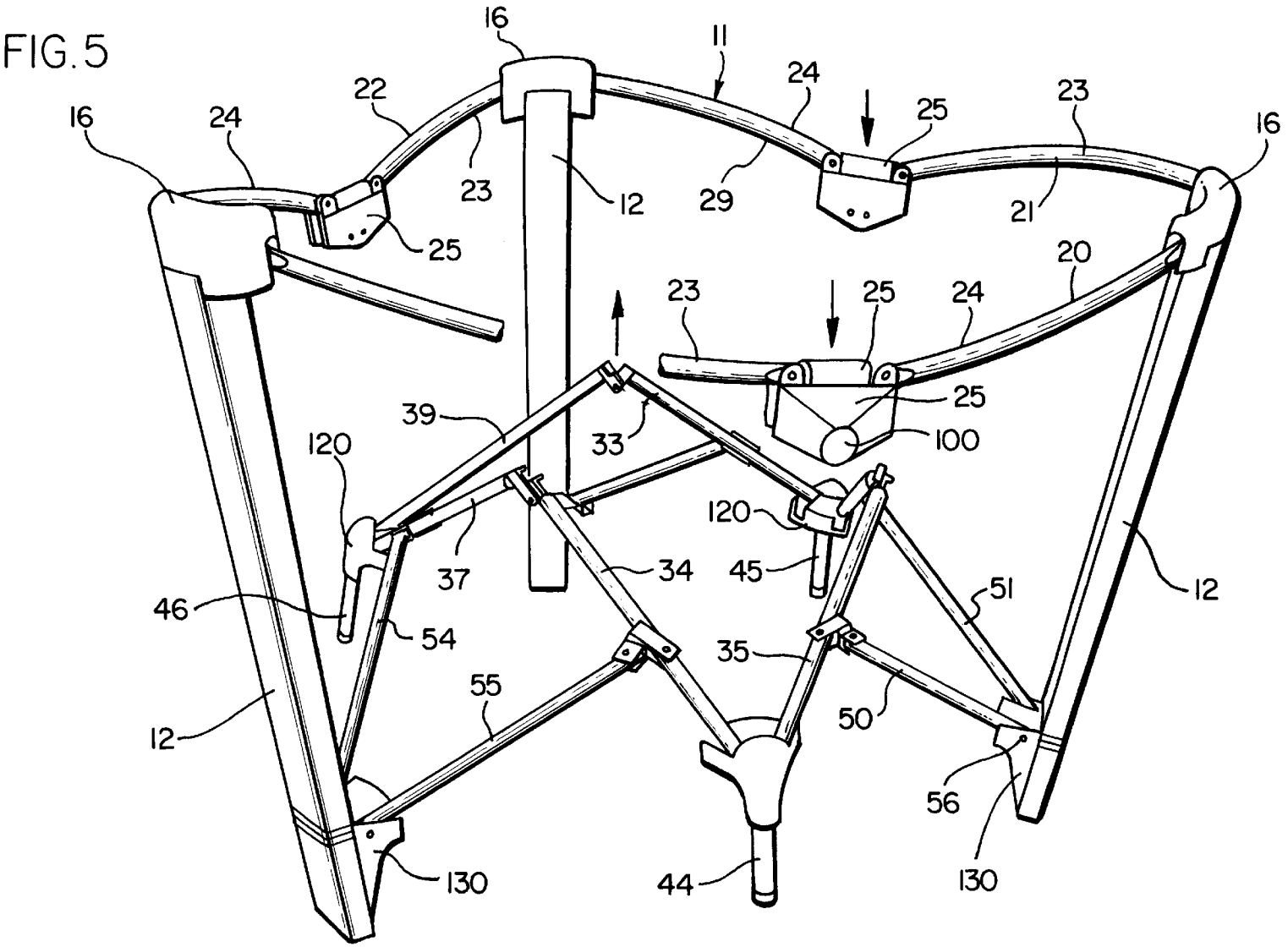
FIG. 5 shows a fragmentary, perspective view of the figure of FIG. 4 with the top assembly and bottom assembly partially collapsed.

Referring to the drawings and particularly FIGS. 4 and 5, one embodiment of play yard 10 comprises frame 11. Frame 11 includes three vertical posts 12, each post having an upper and lower end. A collapsible top assembly 29 includes top rail assemblies 20, 21, 22 each comprising first and second rail members 23, 24. The rail members preferably are slightly bowed to provide a curved configuration such as shown in FIG. 1. Each rail member has one end pivotally connected to a vertical post 12 and a second end pivotally fastened to locking rail joint 25. Cap assembly 16 is disposed over the top end of post 12 and encloses the pivotal connection between a post and corresponding rail members in a manner further described hereafter.

The bottom assembly 30 of play yard 10 includes a collapsible triangular-shaped subassembly 31 which preferably is in the form of an equilateral triangle. The triangle legs 32, 33, 34, respectively, include first leg portions 35, 36, and 37 and second leg portions 38, 39, and 40. One end of each leg portion, e.g., 35, 38 of leg 31, is connected to a pivot joint 41, 42, or 43.

Pedestal 120 is located at each of the three apices 47, 48, 49 of triangular-shaped subassembly 31. Stabilizer feet 44, 45, 46 depend from pedestals 120. Each stabilizer foot is located away from the vertical center axis of the play yard and preferably is located at a point which is beyond a vertical plane which intersects the vertical axes of the vertical posts 12 which are adjacent a stabilizer foot. A stabilizer foot preferably is equally spaced from adjacent vertical posts 12 such that three stabilizer feet and three vertical posts shown in FIG. 4 effectively stabilize the play yard when it is in an erected position.

The stabilizer feet also can be located at the edge of, or more preferably, beyond the maximum outer periphery of the top assembly, bottom assembly or base insert whichever outer perimeter is the largest.

Three pairs of first and second post connecting members (50, 51), (52, 53), and (54, 55) connect vertical posts 12 to triangular-shaped subassembly 31. Specifically, first post connecting members 50, 52, and 54 each have one end pivotally fastened to pedestal 130 at 56, the pedestal being located contiguous to the lower end of vertical posts 12. The remaining ends of the first post connecting members are connected by swivel joint 57 to the respective first leg portions 35, 36, 37 of triangular-shaped subassembly 31. Similarly, second post connecting members 51, 53, and 55, which are positioned at an angle "a" of approximately 60° to the first connecting post members in the erected position, are pivotally connected at 56 to one end to pedestal 130 while the remaining ends are connected by swivel joint 58 to the respective second leg portions 38, 39, 40. It will be noted, for example, viewing FIG. 4, that post connecting members 53 and 54 are in interrupted axial alignment with one another. Similarly, post connecting members 51, 52 and 50, 55 also are in interrupted axial alignment when the play yard is in an erected position. This alignment is preferred inasmuch as the post connecting members serve to support a base insert.

As seen, for example, in FIG. 4, the post connecting member and leg portions of triangular subassembly 31 form three truss segments 3, 4, 5. The truss segments in conjunction with the subassembly 31 form a truss 8. Truss 8 in conjunction with the vertical posts 12 and stabilizer feet serve to provide a play yard which, when erected, is relatively substantially rigid and stable.

Figure 10:
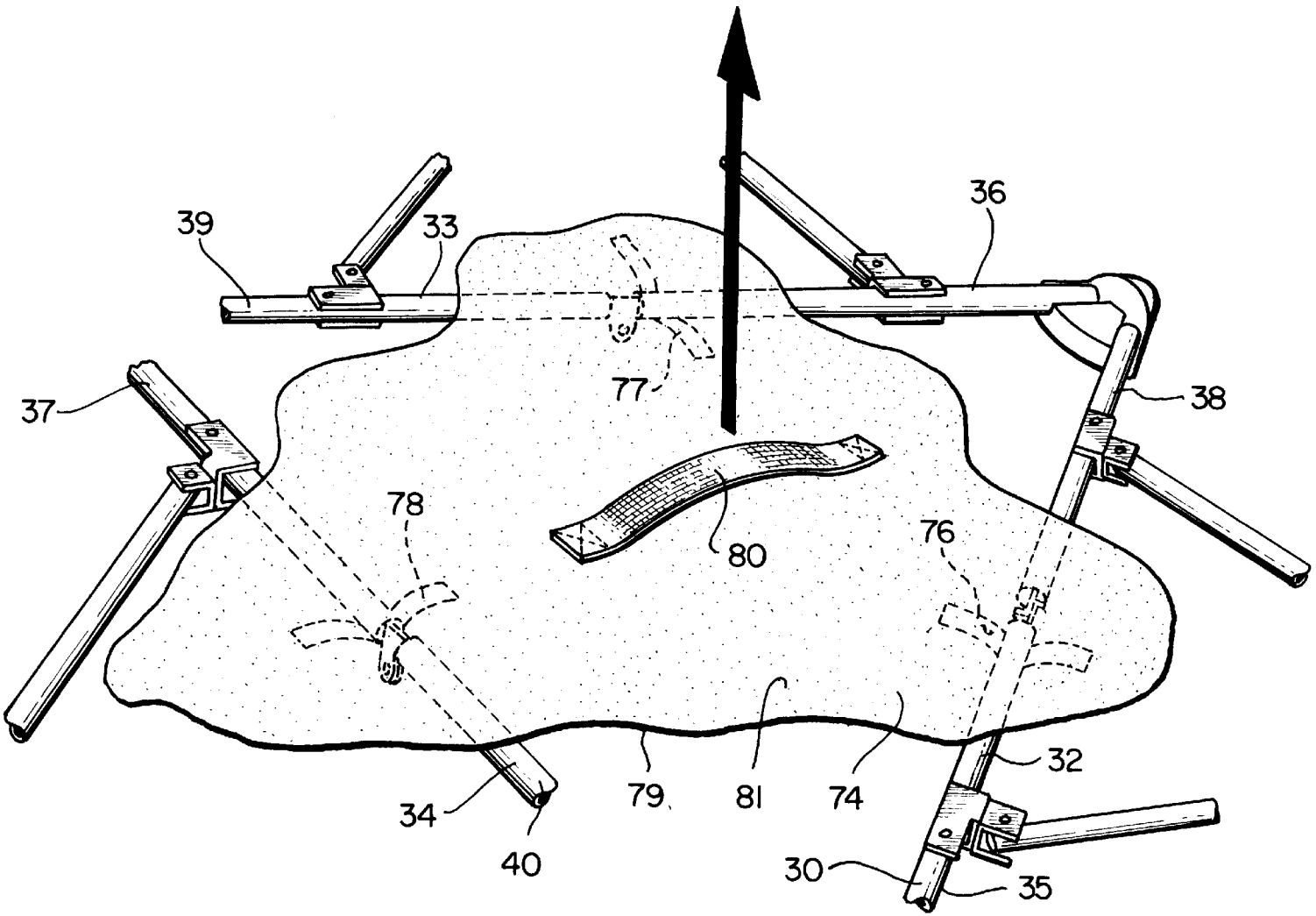
FIG. 10 shows a fragmentary, perspective view of the fabric base panel having a handgrip on its upper surface and attached at its lower surface to the legs of the triangular-shaped subassembly.

Referring to FIG. 1, a panel assembly 70, which is made of a conventional cloth, plastic fabric or other suitable fabric material, is disposed on frame 11. Assembly 70 includes three side panels 71, 72, 73 and bottom panel 74. The top of each side panel member is disposed over a respective rail member 23, 24 and rail joint 25, and stitched or formed to form a sleeve which encloses the rail members and rail joint. The side panels, which also can be a mesh material, if desired, drape downwardly. Bottom panel 74 is stitched or otherwise attached to the bottom edge of the three side panels and is positioned, when the play yard is in an erected position, to normally seat on top of bottom assembly 30. See FIG. 10. Plastic or cloth straps 76, 77, 78 are suitably fastened, by stitching or releasable snaps, to the lower surface 79 of bottom panel 74 and engage at least one of the leg portions 35–40 of triangular subassembly 31. Pull strap 80 is stitched to the upper surface 81 of bottom panel 74.

Preferably, the straps 76–78 engage the bottom assembly 30 at the location of pivot joints 41, 42, 43. If desired, the joint engaging straps can be sewn together at one location on the bottom surface of the bottom panel.

Figure 2:
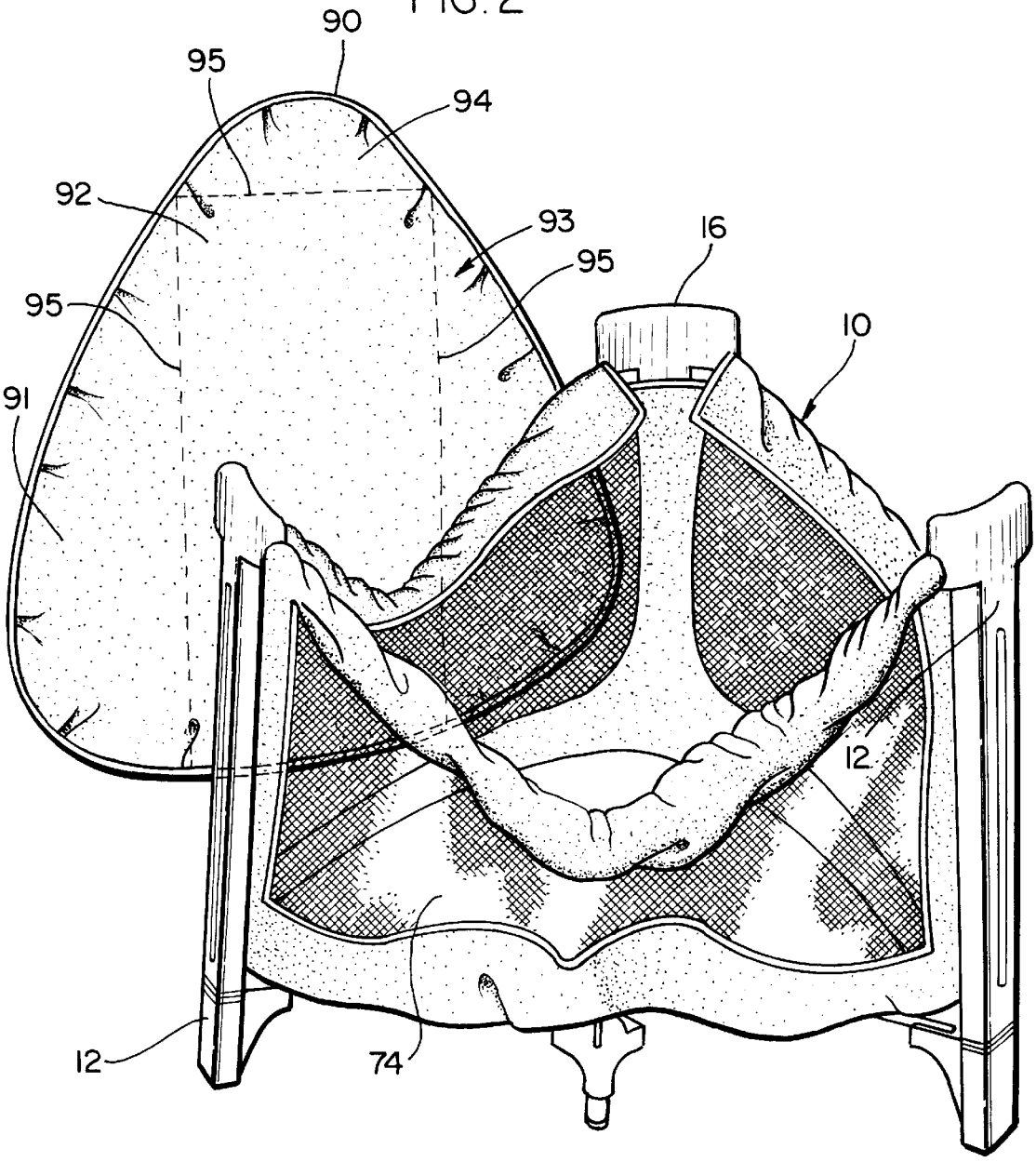
FIG. 2 shows a perspective view of the play yard of FIG. 1 with the base insert removed and the top assembly in a partially collapsed position.
Figure 3:
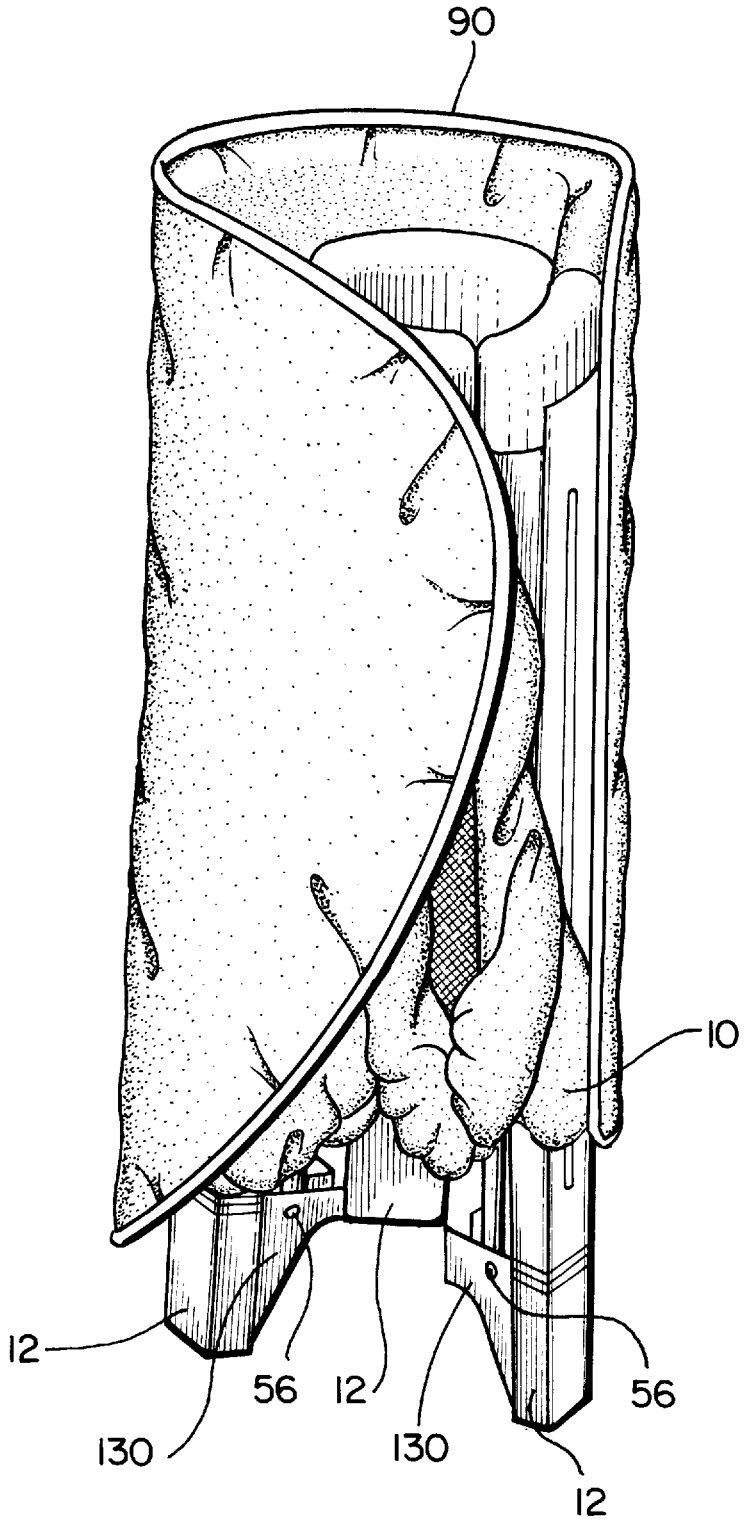
FIG. 3 shows a perspective view of the play yard of FIG. 1 with the play yard in a collapsed position wrapped within the base insert.

Base insert 90, FIG. 2, is adapted to be inserted within the play yard when it is in an erected position and serves as the play yard floor. Preferably, insert 90 comprises a flexible foam or fabric pad over which is stretched or mounted a conventional plastic or cloth fabric material. The insert is formed into four discrete sections 91, 92, 93, 94, the insert sections being foldable relative to one another at the location of fold lines 95. When play yard 10 is in an erected, in use position, as shown in FIG. 1, insert 90 seats on top of bottom panel 74 and truss 8 and is configured to contact the lower inside surfaces of side panels 71, 72, 73. Insert 90 while being flexible, also is of sufficient rigidity such that when it is inserted in play yard 10, it assists in maintaining the side panels in a relatively taut condition, while providing a relatively soft floor surface for an infant or child disposed within the play yard. After the play yard is placed in a collapsed position of FIG. 3, insert 90 can be utilized as a wrap for enclosing play yard 10.

Figure 7:
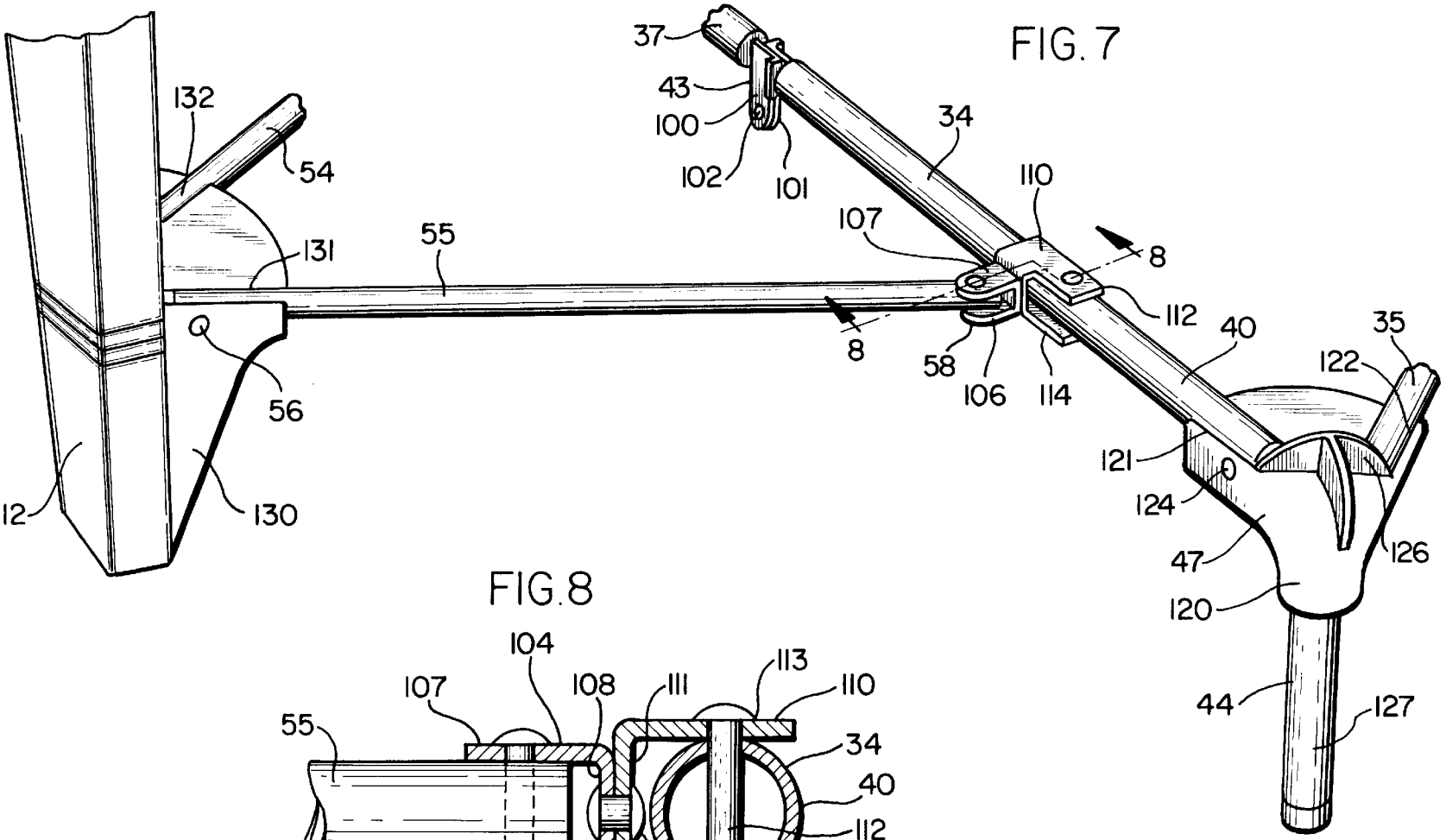
FIG. 7 shows a fragmentary, perspective view of the lower end of a vertical post having a pair of post connecting rod members pivotally connected to the vertical post and swivelly connected to a leg portion of a triangular-shaped subassembly, the play yard being in an erected position.
Figure 8:
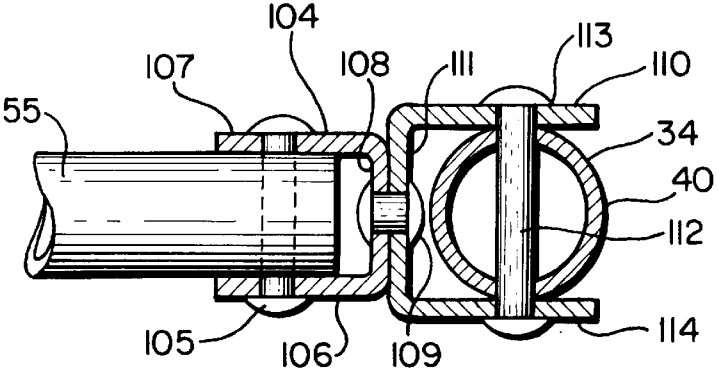
FIG. 8 shows a section view of a swivel joint taken along lines 8—8 in FIG. 7.
Figure 9:
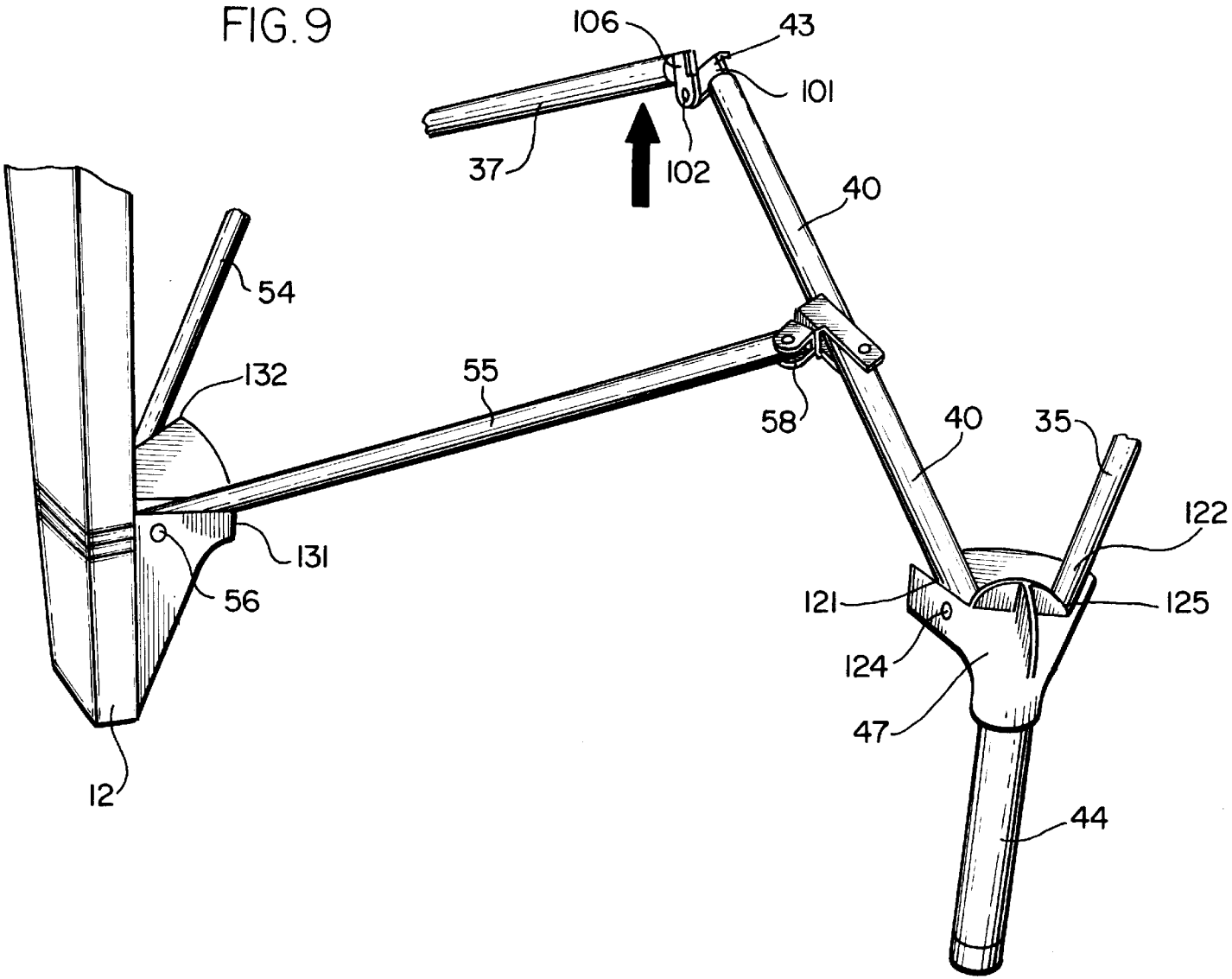
FIG. 9 shows the post connecting member of FIG. 7 in the course of collapse of the play yard.

Referring to FIGS. 7–9, pivot joint 43 includes a first bracket 100 fixed to an end of first leg portion 37, while a second bracket 101 is fixed to an end of second leg portion 40. Brackets 100, 101 are riveted or otherwise fastened together to allow the brackets to pivot relative to each other a predetermined amount at the location of the rivet or connector 102 which joins the two brackets as illustrated in FIGS. 7 and 9. The first and second leg portions are adapted to pivot downwardly when subassembly 31 is pulled upwardly in the direction of the arrow shown in FIG. 9; however, as seen in FIG. 7, the leg portions will remain substantially axially aligned with one another when in the erected position. Thus, the leg portions are permitted to pivot relative to one another a predetermined limited amount. Pivot joints 41 and 42 comprise the same structure utilized for pivot joint 43.

Swivel joint 58, utilized for example, with second leg portion 40 and post connecting member 55 includes a first U-shaped bracket 104 having bracket walls 106, 107. See FIG. 8. The second end of post connecting member 55 is riveted or otherwise fastened at 105 to the bracket walls so that post connecting member 55 pivots about bracket 104. Bracket base 108 is riveted at 109 to bracket base 111 of a second U-shaped bracket 110 whereby brackets 104 and 110 are adapted to rotate relative to one another at the location of rivet 109. Rivet 112 extends through second bracket walls 113, 114 and leg portion 40 whereby leg portion 40 pivots about second bracket 110. Swivel joints 57 utilize the same structure as described for swivel joint 58.

Pedestal 120 is located at each of the apices 47, 48, 49 of triangular-shaped subassembly 31, see FIGS. 7 and 9. Each pedestal includes slotted openings 121, 122 adapted to receive leg portions of triangular subassembly 31. The leg portions, e.g., 35, 40 are pivotally connected by a rivet or other suitable fastener to pedestal 120 at 124. Base insert stop 126 is disposed on the top of and integral with pedestal 120. The stops 126 are adapted to seat against base insert 90 so that, in conjunction with vertical posts 12, the movement of base insert 90 can be restricted when the insert is disposed in an erected play yard whereby the base insert cannot be substantially rotated out of its normal position. Stabilizer foot 127 is integrally fixed to pedestal 120. The pedestal and foot structures for apices 48 and 49 are the same as described for the pedestal located at apex 47.

Referring again to FIGS. 7 and 9, pedestal 130 is fixedly fastened to post 12 contiguous to the lower end thereof. Pedestal 130 includes slotted openings 131, 132 for receipt of post connecting members 54, 55, the connecting members being pivotally connected by rivet or other suitable fastening means to pedestal 130 at the location of pivot 56, only one of which is shown in FIGS. 7 and 9. Similar pedestals 130 are fixed to the remaining vertical posts 12 for receipt of pivotal post connecting members 50, 51 and 52, 53.

Turning to the top assembly 29 and FIGS. 11–14, rail joint 25 includes two side plates 140, 141 integrally connected to U-shaped top member 142. The end of a rail member 23 and 24 is fixedly disposed within the respective catches 143, 144 which are pivotally connected at 145, 146 to the side plates of rail joint 25. Catches 143, 144 have notched latches 147, 148 located at their respective outboard ends.

Hinge arms 149, 150 are split members (see FIG. 11) mounted for rotation on shafts 151, 152 respectively. One end of each hinge arm 149, 150 includes finger 153, 154, respectively, the fingers being adapted to be engaged by corresponding notch latches 147, 148 to lock the hinge arms in the position shown in FIG. 11. The remaining hinge arm end 155 and hinge arm 149 includes a plurality of gear teeth 157 which are adapted to mesh with gear teeth 158 located at the second end 156 of hinge arm 150. The coupling of the hinge arms 149, 150 by the gear teeth causes the rail members fastened to rail joint 25 to function in unison and, most importantly, it precludes one rail member from unlocking while the remaining rail member remains locked. Spring 159, which is illustrated as a wire form spring, is disposed on shafts 151, 152 and serves to bias and maintain hinge arms 149, 150 in a normally closed position whereby fingers 153, 154 engage latches 147, 148 when play yard 10 is in an erected position.

Knob 160 is located at one end of an elliptical-shaped shaft 161 which, in turn, is mounted on shaft 162. Shaft 162 is mounted for rotation at 163, 164 on joint sides 140, 141. Elliptical-shaped shaft 161 is disposed between and adapted to serve as a cam against hinge arm sides 165, 166.

Figure 11:
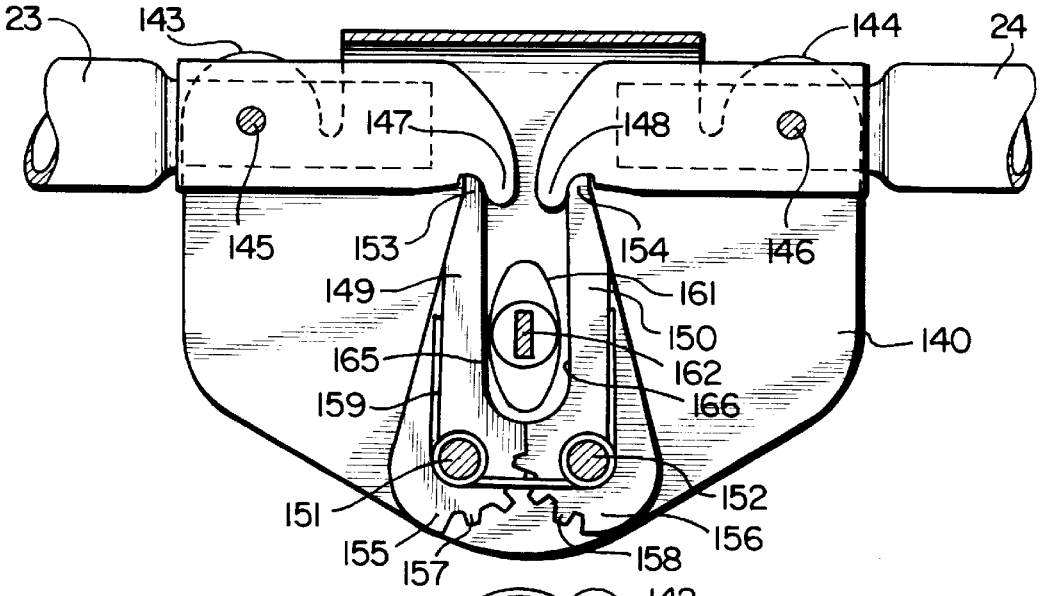
FIG. 11 shows a fragmentary rear section view of a locking rail joint located in the top assembly.
Figure 12:
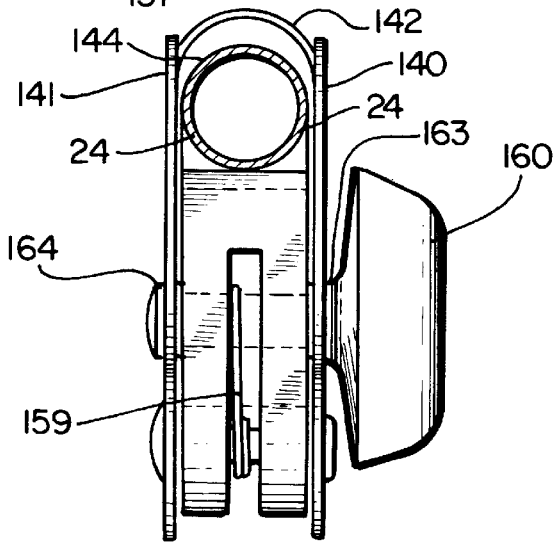
FIG. 12 shows a right end view of the rail joint of FIG. 11.
Figure 13:
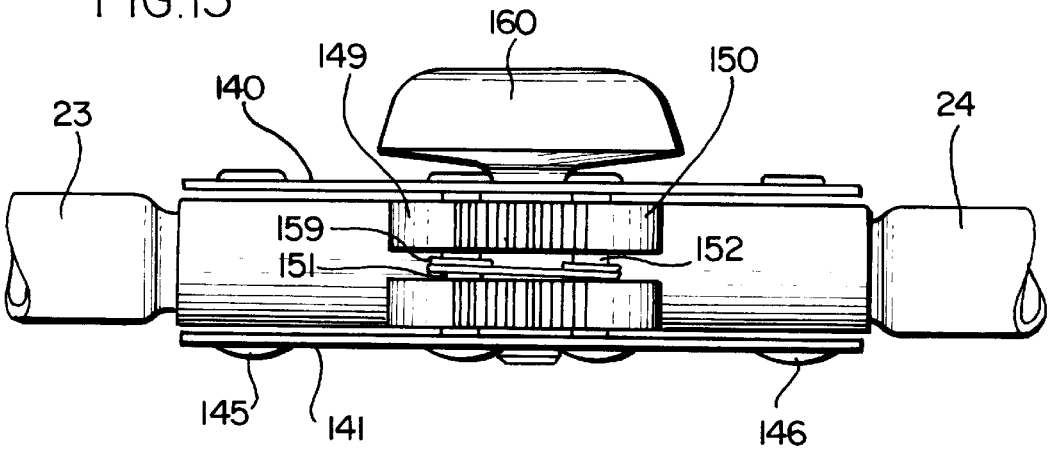
FIG. 13 shows a bottom plan view of the rail joint of FIG. 11.
Figure 14A:
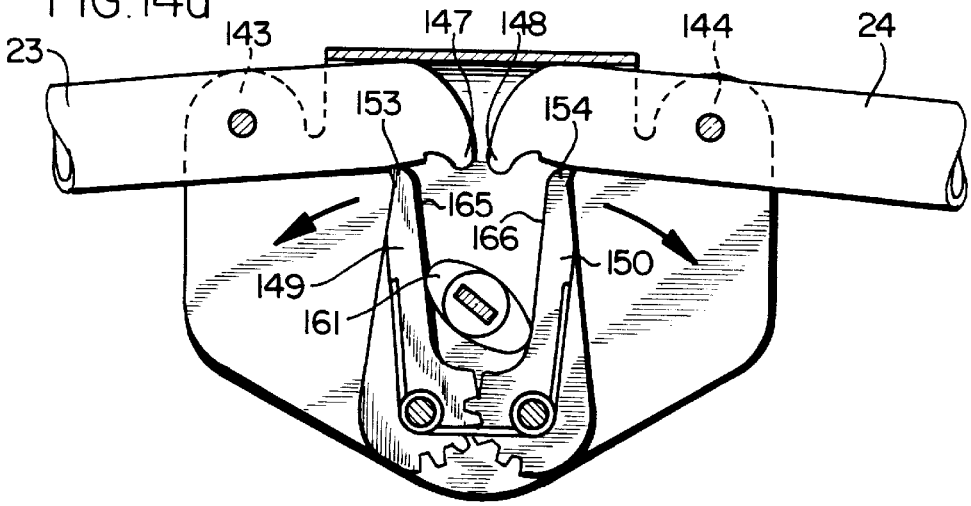
FIGS. 14 *a–c* show the incremental collapse of the locking rail joint of FIG. 11.
Figure 14B:
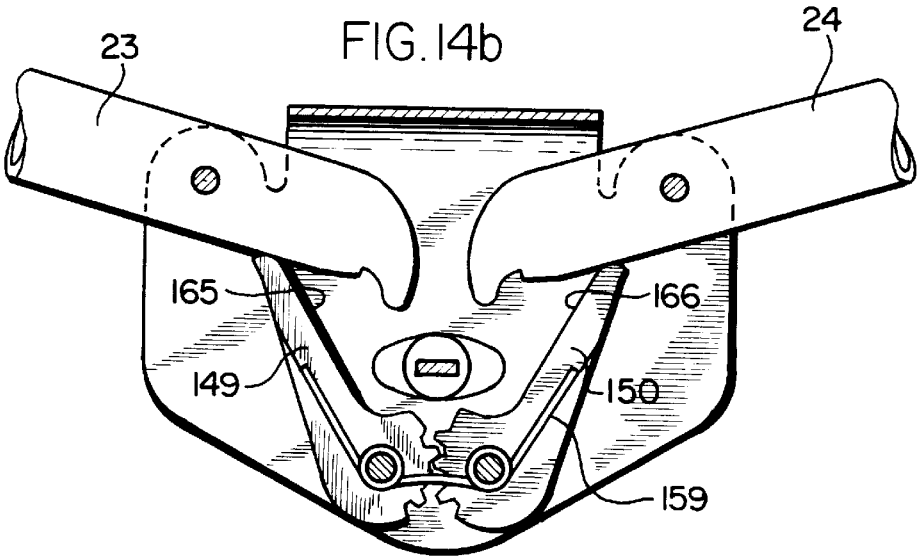

When it is desired to collapse play yard 10, a rail joint 25 is grasped and initially pulled upwardly whereby catches 143, 144 become free to move from the position shown in FIG. 11 to the position shown in FIG. 14*a*. Knob 160 then is rotated, whereupon the elliptical-shaped shaft 161 cams against or otherwise contact the respective sides of the hinge arms as seen in FIGS. 14*a* and 14*b*, causing hinge arms 149, 150 to move outwardly in the direction of the arrows shown in FIG. 14*a* beyond the location of notched latches 147, 148. Once the hinge arms are released from the notched latches, rail members 23, 24 will continue to collapse in a downward position as seen in FIG. 14*c*.

Figure 14C:
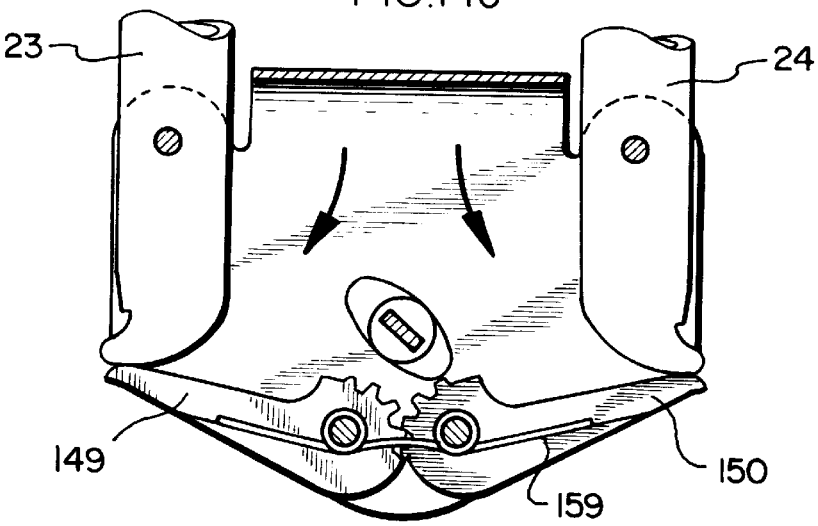

When it is desired to assemble play yard 10 in an erect position, one pulls up on rail member assemblies 20, 21, 22, FIG. 14*c*, thereby allowing hinge arms 149, 150 to return to the position where fingers 153, 154 engage notched latches 147, 148 as illustrated in FIG. 11. Spring 159 assists in biasing and maintaining hinge arms 149, 150 in the normal erected position shown in FIG. 11.

Figure 15:
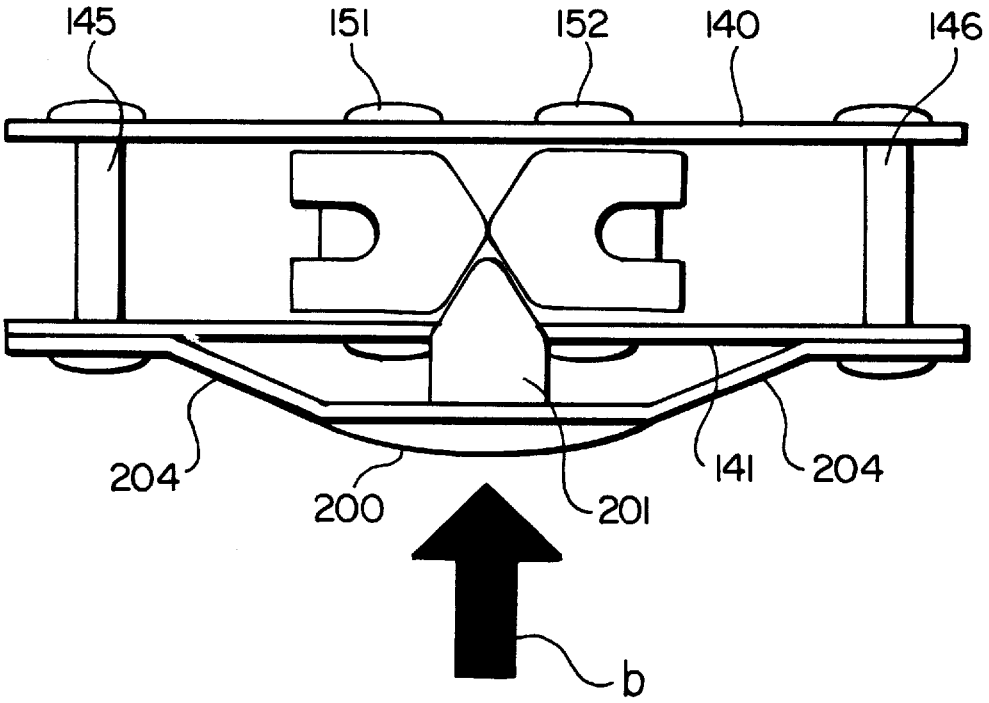
FIG. 15 shows a further embodiment of a locking rail joint utilizing a push button release.

If desired, rotating knob 160 and elliptical-shaped shaft 161 could be replaced by any device which would act to spread or otherwise cause rotation of the catches 143, 144, such as a spring biased button, which is located along a side of rail joint, could be urged inwardly against a suitable compression spring. For example, FIG. 15 shows the locking rail joint of FIGS. 11–14 with knob 160 replaced by button 200 having tapered shaft 201. Button 200 is biased away from rail joint side plate 141 by a suitable compression spring member 204 fixed to side plate 141 whereby button

200 is spaced from side plate 141 as shown in FIG. 15. When it is desired to collapse rail joint 25, button 200 is pushed inwardly in the direction of the arrow "b" in FIG. 15. As button 200 is moved toward plate 141, tapered shaft 201 engages the sides 165, 166 of hinge arms 149, 150 and cams the arms apart as previously described. The locking rail joint configuration can be utilized with any other suitable device designed to cause hinge arms 149, 150 to rotate in the manner shown in FIGS. 14*a–c*.

Figure 6:
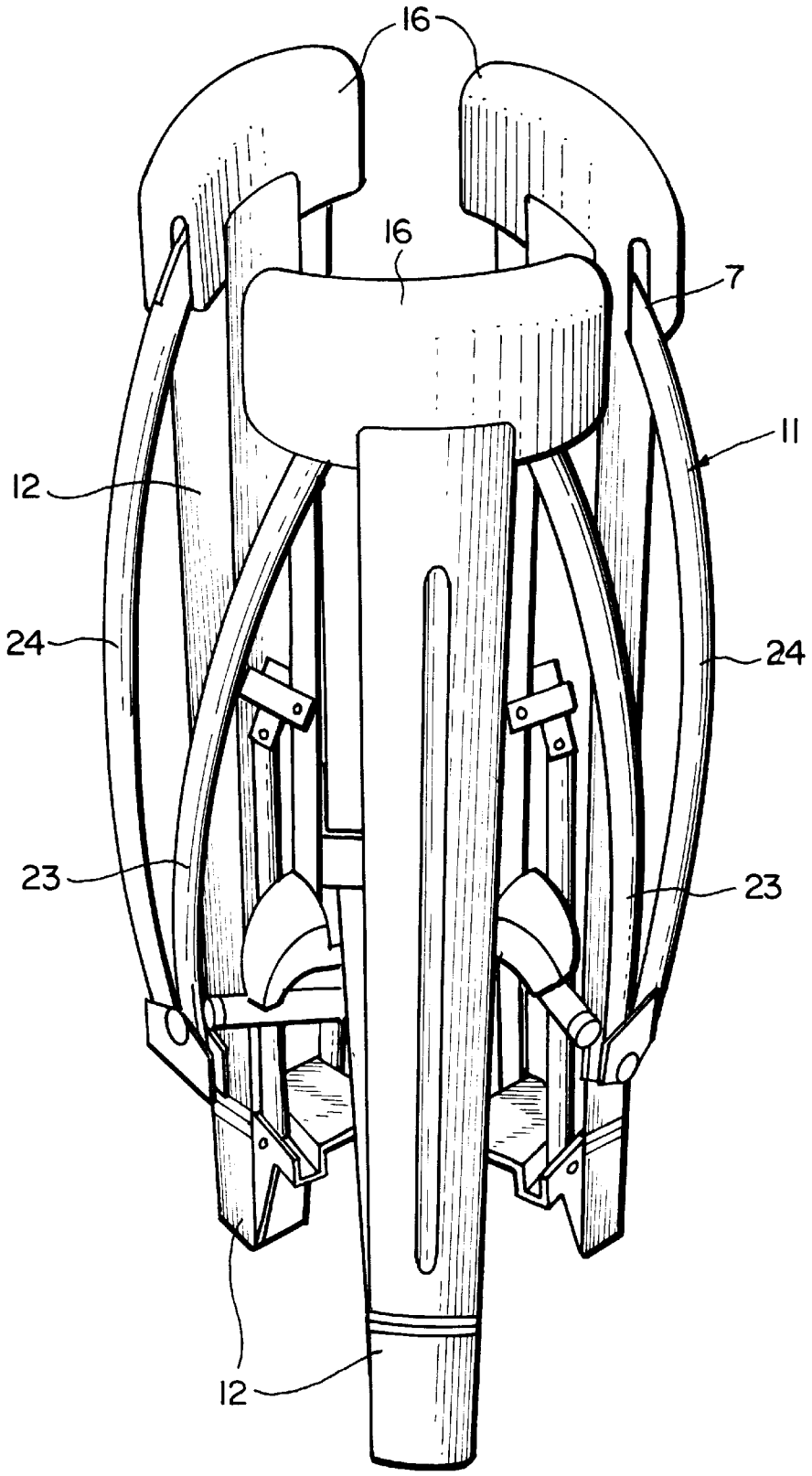
FIG. 6 shows a perspective view of the frame of FIG. 4 collapsed.

To collapse play yard 10 from the erected position shown in FIG. 1, one pulls up on rail joints 25 and cams the fingers to an unlocked position whereupon the top rail assemblies 20, 21, 22 collapse. Then, with the base insert 90 removed from the play yard, upon pulling upward on strap 80, FIG. 10, the leg portions of triangular-shaped subassembly 31 pivot upwardly, FIGS. 4 and 5. The post connection members, i.e., (50, 51), (52, 53), (54, 55) swivel as the leg portions of triangular-shaped subassembly 31 move upwardly. Vertical posts 12 move inwardly, whereupon the play yard assumes the folded, collapsed position illustrated in FIGS. 2, 3, and 6. Subsequently, insert 90 is wrapped about folded play yard 10, FIG. 3, whereupon the folded and wrapped unit can be inserted in a suitable bag-like carrying container.

Figure 17:
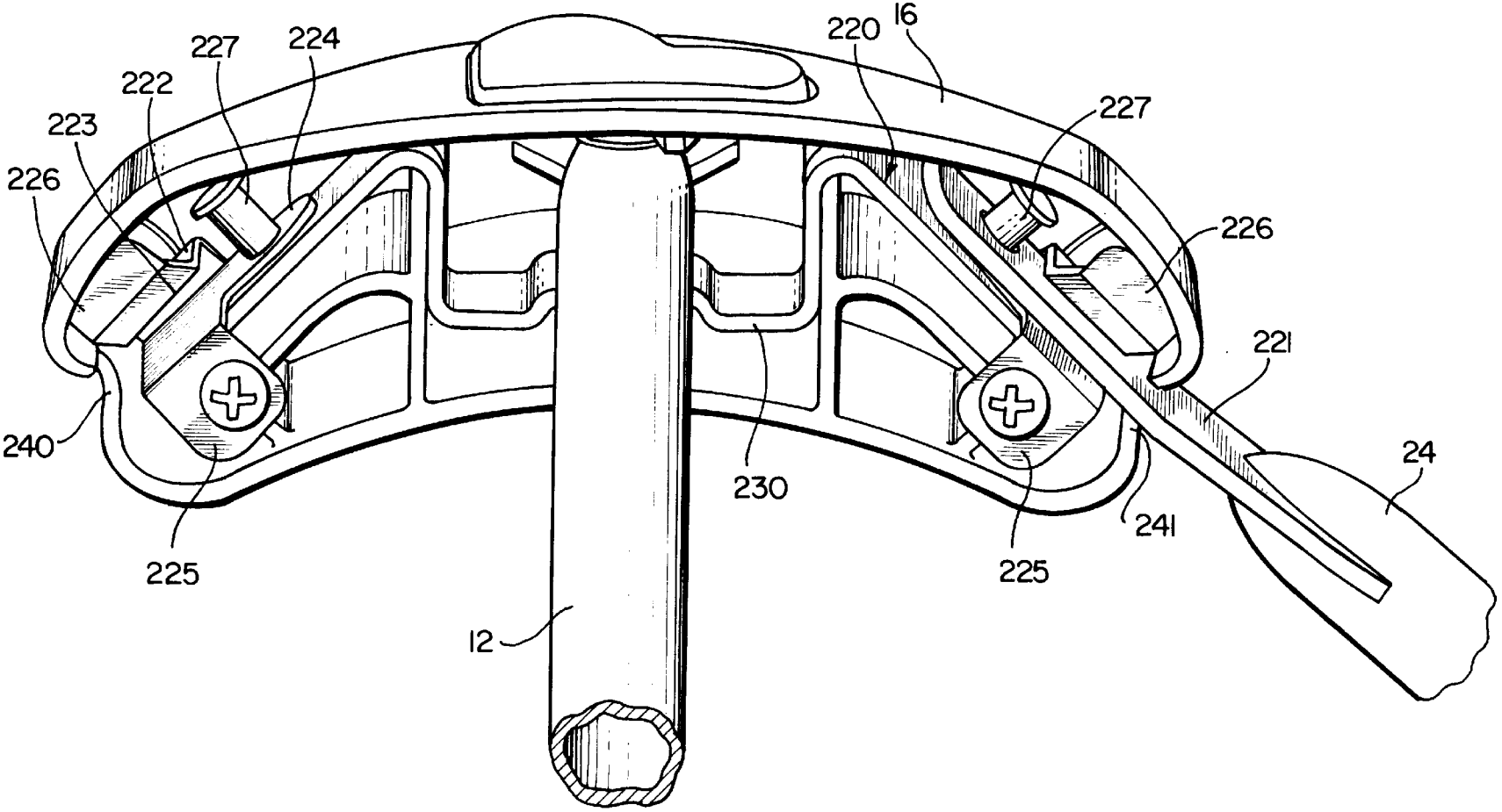
FIG. 17 shows a fragmentary perspective view of the bottom of a vertical post cap assembly.
Figure 18:
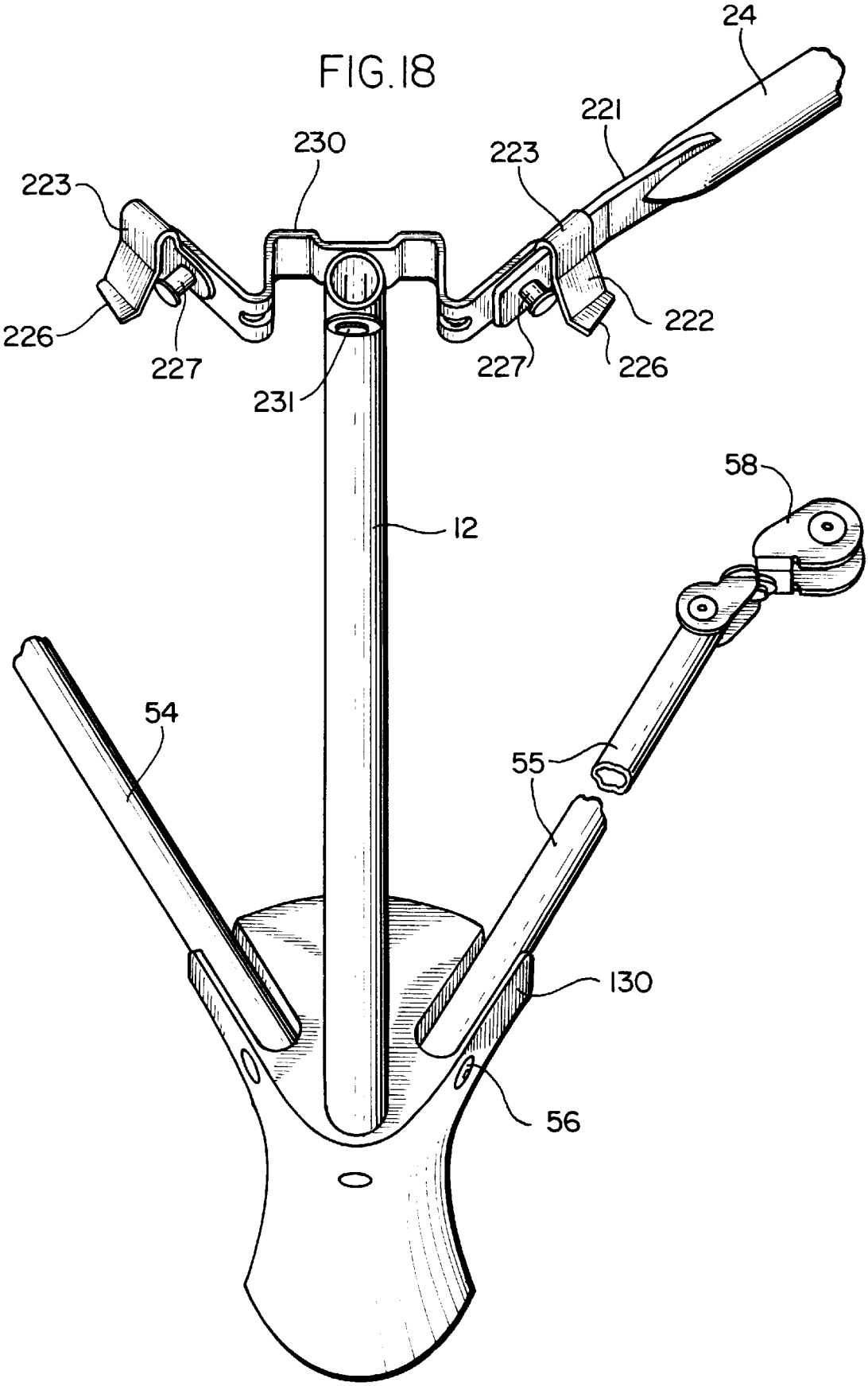
FIG. 18 shows a rail member end connected to a vertical post cap assembly with the cap removed and the rail member in an erected position.
Figure 19:
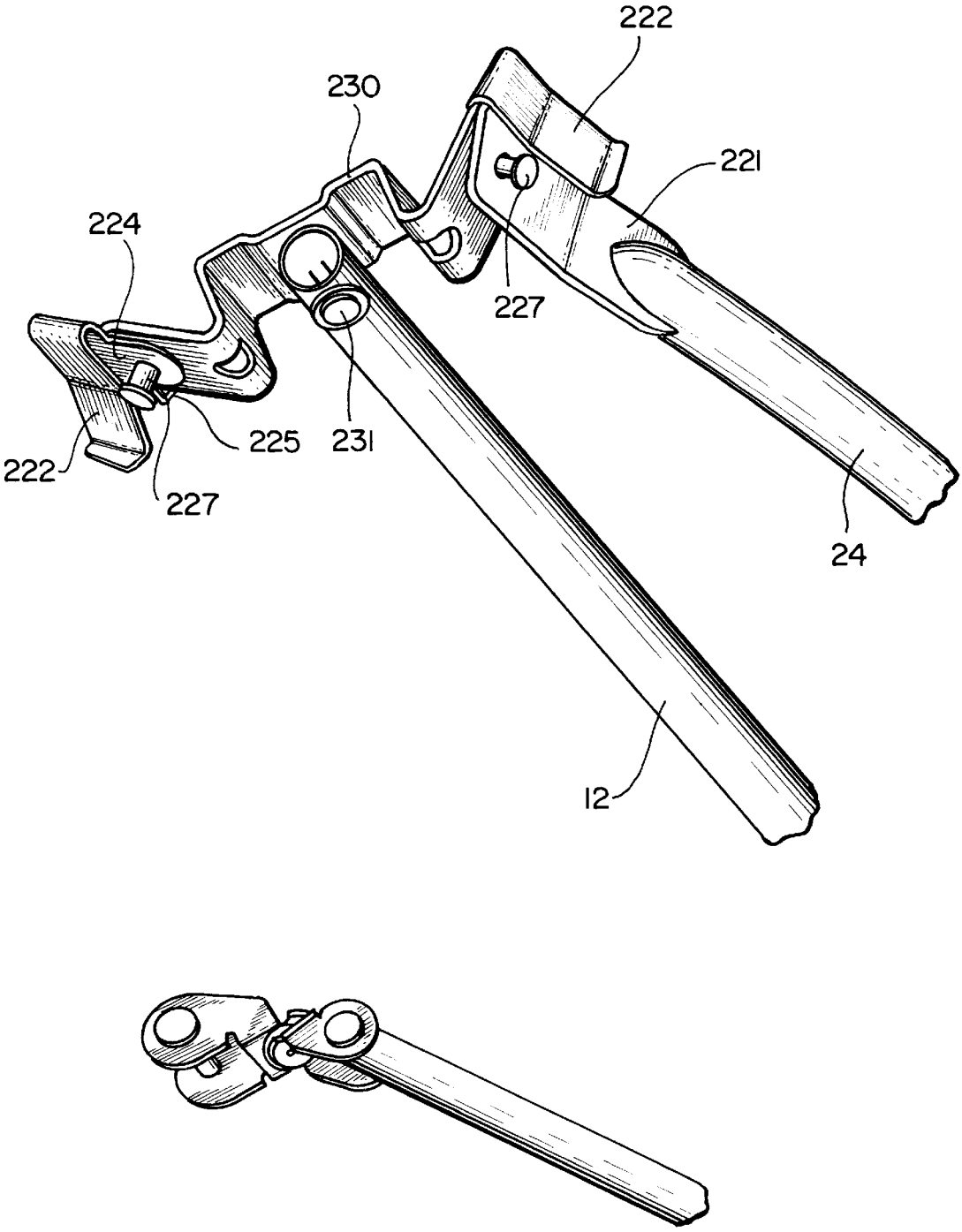
FIG. 19 shows the rail member of FIG. 18 in a collapsed position relative to a vertical post cap assembly.
Figure 20A:
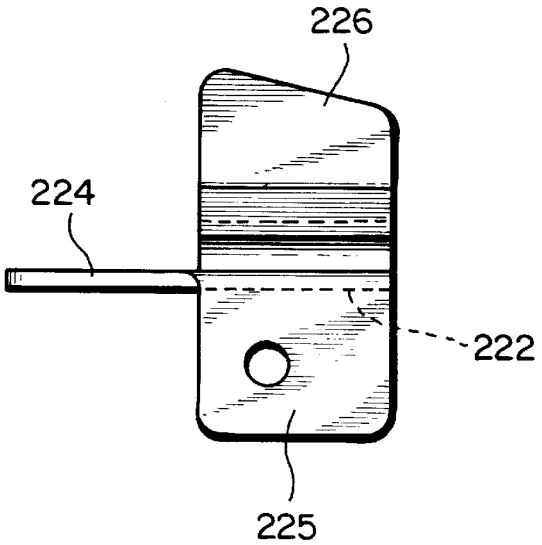
FIGS. 20*a, b*, and *c*, respectively, show the top, front, and side views of a cinch utilized in the vertical post cap assembly of FIG. 18.
Figure 20B:
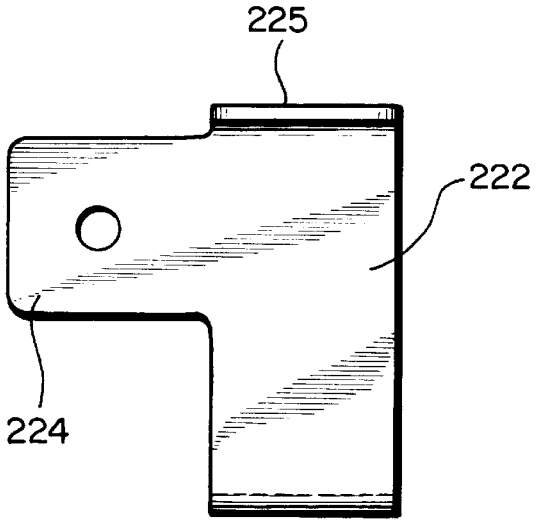
Figure 20C:
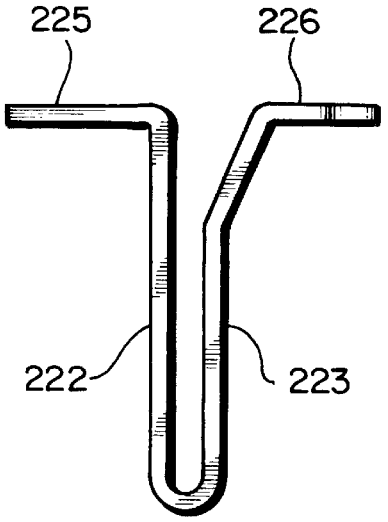

Referring to FIGS. 17–20, rail members 23, 24 each have one end connected to vertical post 12. As seen in FIG. 17, cap 16, which is disposed on post 12, has two slots 240, 241. Cap 16, which has a recessed bottom, encloses assembly 220 which is adapted to connect rail members 23, 24 to vertical post 12. FIG. 17 shows rail member 24 having one end formed to a substantially flat rail end 221 which is adapted to fit within cap slot 241. Rail member end 221 is adapted to be inserted in cinch 222. Cinch 222 includes tapered slotted section 223 and plate extensions 224, 225, 226. The formed rail member end 221 is adapted to seat within the tapered slot section 223. FIG. 17 shows rail member end 221 inserted in slot section 223 whereas the remaining tapered slot section in FIG. 17 is illustrated free of a rail member end. The rail end is pivotally connected to cinch 222 by means of a rivet 227 of a desired length which passes through an opening in end 221, plate extension 224 and corner support brace 230. Corner support brace 230 is adapted to be fastened to vertical post 12 by a suitable fastener such as rivet 231. When a rail member 23 or 24 is in an erect position such as shown in FIGS. 17, 18, the rail members are snugly positioned within slotted cinch section 223 and cap slot 240 or 241. In this position, the rail members are retained from substantial lateral movement. When rail joints 25 are collapsed, however, rail members 23, 24 drop to a position where the flat formed ends of the rail members are no longer positioned within the tapered cinch sections 223 or cap slots 240, 241, see FIG. 19, such that the rail members 23, 24 have a substantial freedom of lateral movement along the length of rivet 227 which serves to assist in collapsing play yard 10.

Figure 16:
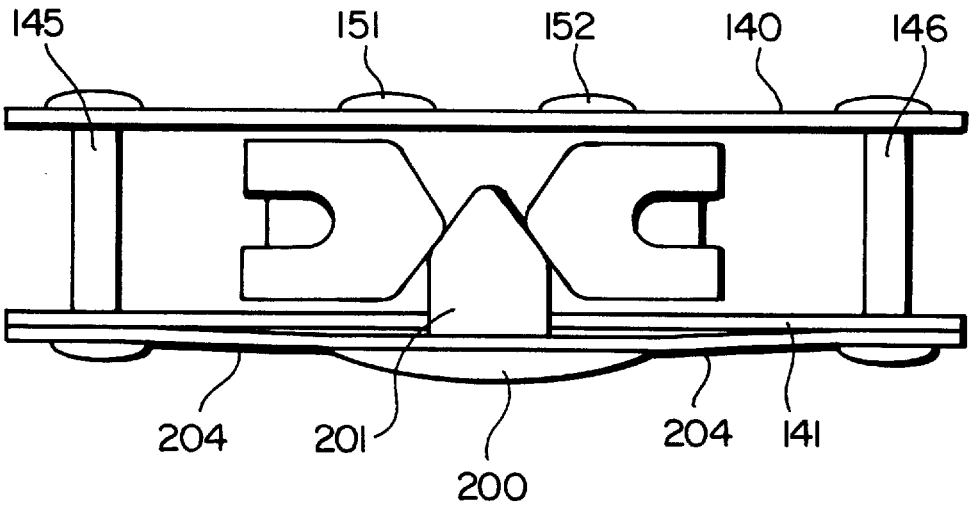
FIG. 16 shows the locking rail joint of FIG. 15 with the push button pushed inward to engage the joint hinge arms.
Figure 21:
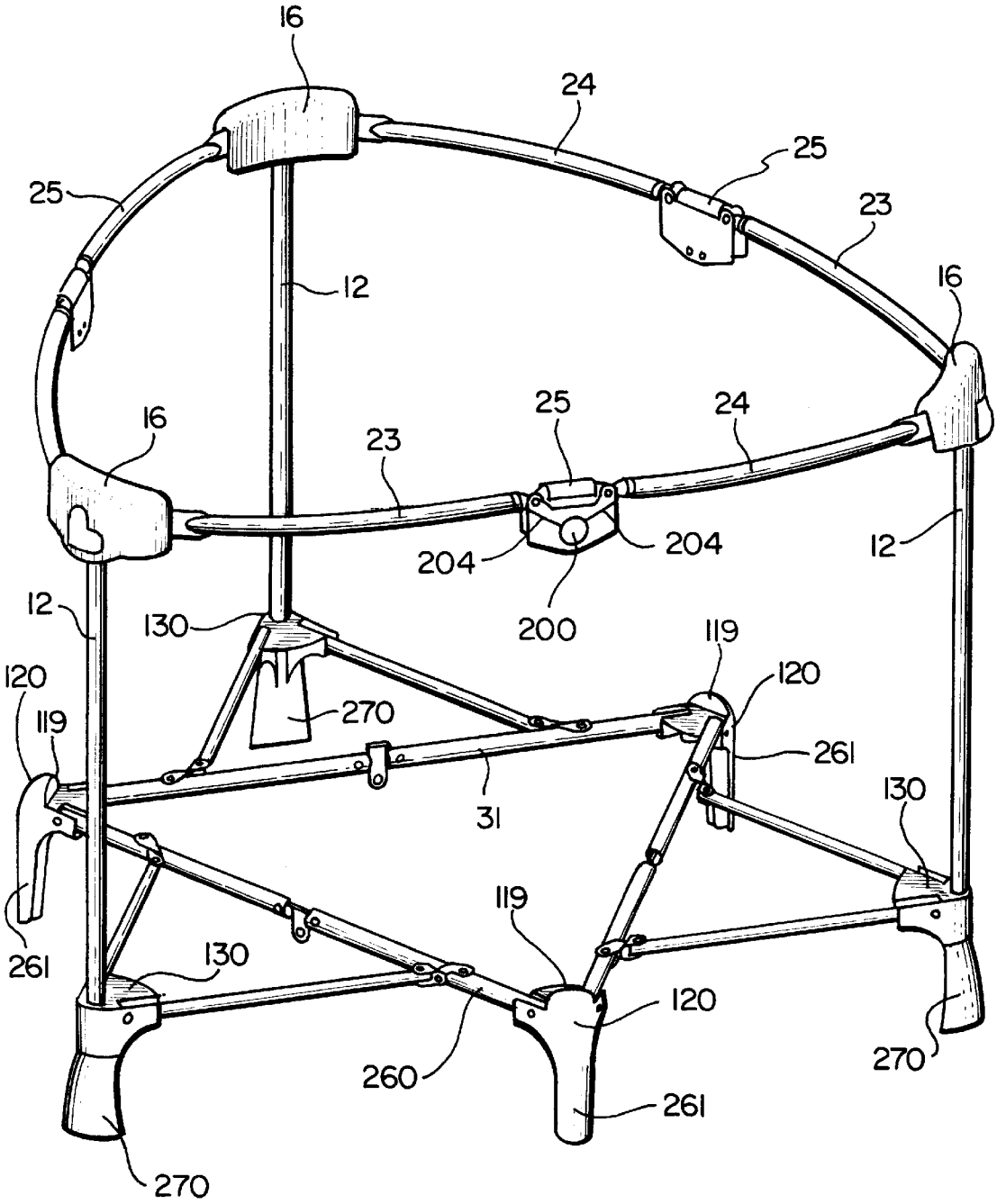
FIG. 21 shows a second embodiment of the play yard frame of the present invention in an erected position.
Figure 22:
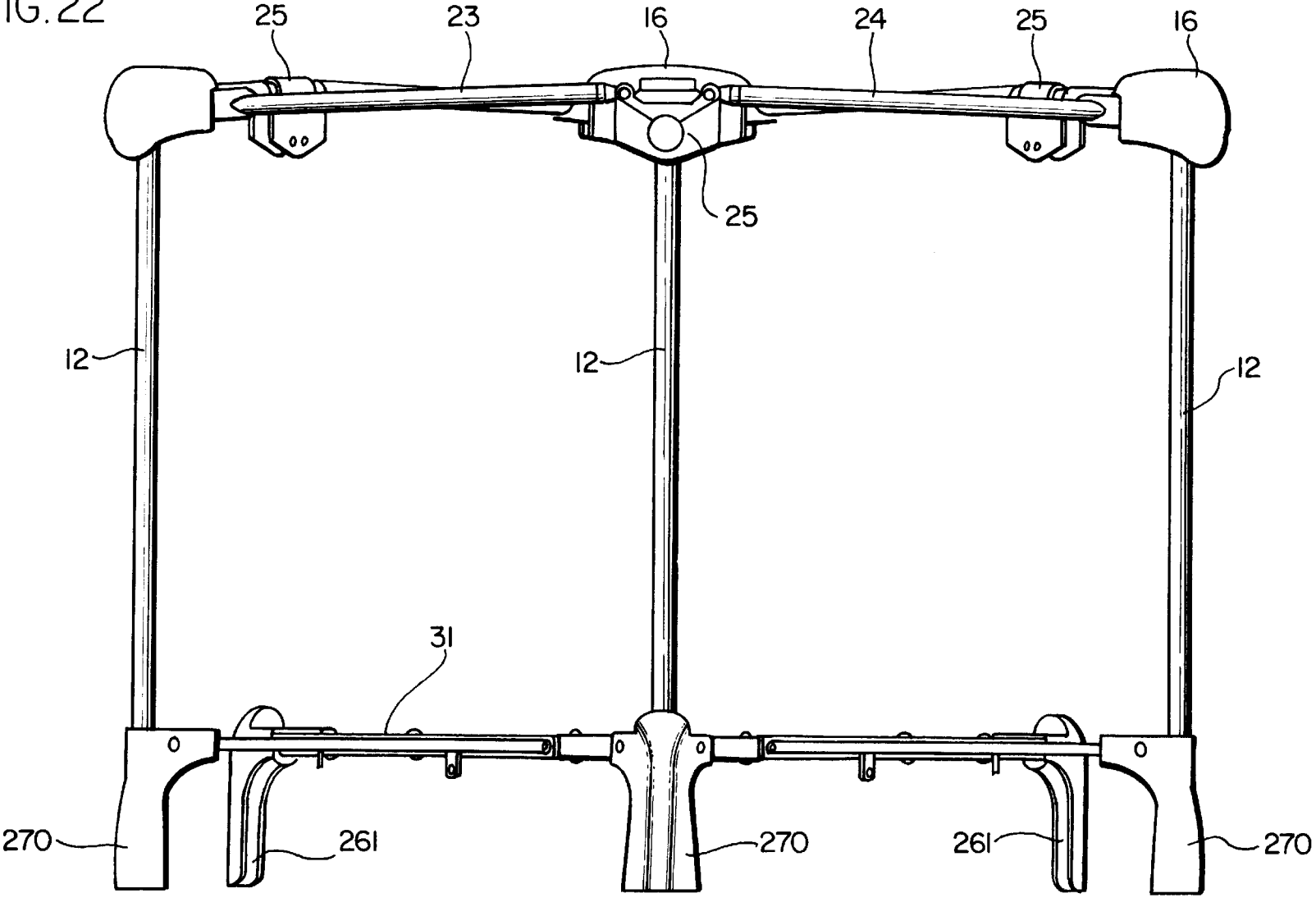
FIG. 22 shows a side view of the play yard frame of FIG. 21.
Figure 23:
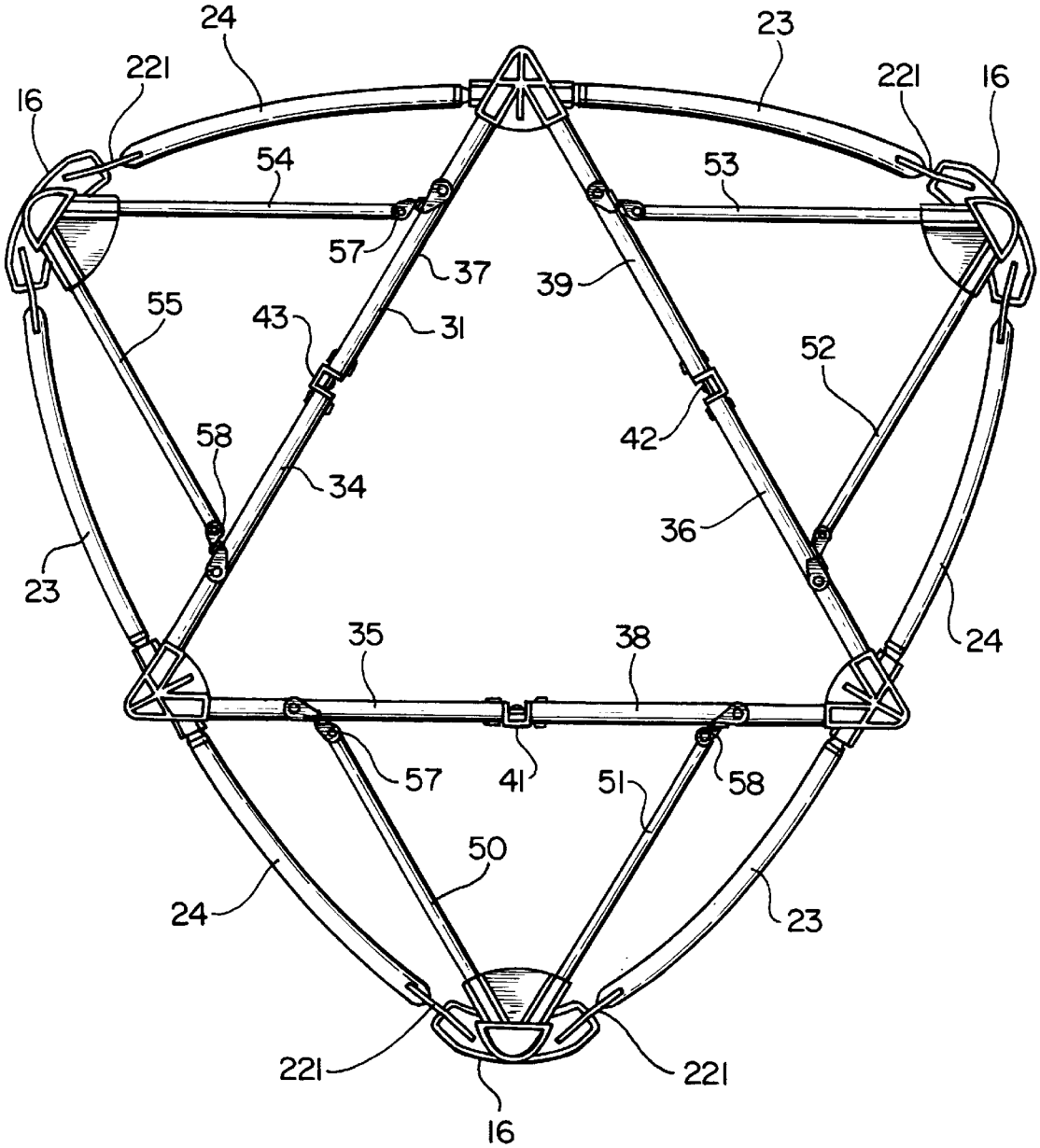
FIG. 23 shows a bottom plan view of the play yard frame of FIG. 21.

FIGS. 21–23 show a further embodiment of the play yard of the present invention. In this embodiment, vertical post 12 comprises tubular members as opposed to employing a cowling or hollow molded column as illustrated in FIG. 1. The locking rail joints 25 employ the push button embodiment disclosed in FIGS. 11, 15, and 16 while the cap assemblies 16 utilize the cinches disclosed in FIGS. 17–20 to connect rail members 23, 24 to vertical posts 12.

Collapsible bottom assembly 260 includes pedestals 120 having stabilizer feet 261 depending therefrom. Base stop 119 is integral with pedestal 120. The bottom end of vertical post 12 includes a foot pad 270 which is connected to and depends from pedestal 130. The triangular subassembly 31 and post connecting members form a truss comprising the truss segments previously described.

The frame of the play yard of the present invention can be made of any suitable metal, plastic or fiberglass material or mixtures thereof.

Moreover, while the truss arrangement disclosed herein has been illustrated with a three-sided play yard, 25 it is appreciated the truss could be utilized with multisided play yards. For example, a five-sided play yard could be employed in which various stabilizer feet and truss segments could be developed to carry various loads acting on the play yard. A collapsible pentagonal subassembly would be utilized in place of the triangular-shaped subassembly 31 and truss segments formed by the post connecting members and subassembly legs could be utilized as required.

Similarly, while a triangular-shaped subassembly and truss segments have been shown, it is appreciated that other shapes could be utilized without departing from the spirit of the invention. For example, it is expected a collapsible round, concave or convex shape subassembly could be utilized. Similarly, the post connecting members could be curved, as required, the requirement being that the truss segments must serve, in conjunction with the subassembly, as a truss to support the desired loads.

Further, the top assembly has been illustrated with bowed members. It is appreciated that the rail members could be straight or otherwise shaped without departing from the spirit of the present invention.

While the present invention has been described in connection with a single embodiment, it will be understood to those skilled in the art that many changes and modifications may be made without departing from the true spirit and scope of the invention. It is therefore intended by the appended claims to cover all such changes and modifications which come within the true spirit and scope of the invention.

What is claimed is:

1. A triangular-shaped play yard comprising:

a collapsible, triangular-shaped top assembly;

a collapsible, triangular-shaped bottom assembly; and, three spaced vertical posts each having upper and lower ends;

said top assembly connected to said vertical posts contiguous to the upper ends of said posts; and, said bottom assembly connected to said vertical posts contiguous to the lower ends of said posts and including (a) a triangular-shaped subassembly comprising three collapsible legs; and, (b) pairs of post connecting members having one end of each member connected to a vertical post and a second end of each member connected to a subassembly leg to form truss segments between each post and said subassembly leg;

whereby said top and bottom assemblies can be erected to an assembled position and collapsed to a disassembled position.

2. A triangular-shaped play yard comprising:

three vertical post members each having a top end and a bottom end;

a collapsible triangular-shaped top assembly connecting said vertical posts, said top assembly comprising three rail assemblies;

each rail assembly connecting adjacent vertical posts contiguous to said top ends and including a pair of rail members and a collapsible locking rail joint connecting said rail members;

a collapsible bottom assembly connecting said three vertical posts contiguous to the bottom end of said posts; and, three stabilizer feet, each stabilizer foot being located substantially equidistant between adjacent vertical posts and being spaced outwardly from a line connecting the corresponding adjacent posts, in a direction away from a central portion of the top assembly.

3. A play yard as defined in claim 2 wherein the rail assemblies curve outwardly and a most outward point of each rail assembly is disposed in substantial vertical alignment with a corresponding one of the stabilizer feet.

4. A triangular-shaped play yard comprising:

three vertical post members each having a top end and a bottom end;

a top assembly comprising three rail assemblies, each rail assembly including first and second rail members connected to a collapsible locking rail joint and to a vertical post, each collapsible locking rail joint being configured to permit each rail assembly to collapse;

a bottom assembly comprising a collapsible triangular subassembly comprising three legs, each leg including a first leg portion, a second leg portion, and a pivot joint pivotally connecting adjacent ends of said first and second leg portions;

said bottom assembly further including three pairs of first and second post connecting members; and, each pair of post connecting members comprising (a) a first post connecting member having a first end pivotally connected to a vertical post member and a second end pivotally connected to the first leg portion of a subassembly leg, and (b) a second post connecting member having a first end pivotally connected to said vertical post member and a second end pivotally connected to the second leg portion of said subassembly leg whereby said post connecting members and said leg portions form triangular-shaped truss segments such that said truss segments and subassembly form a lower assembly truss.

5. A play yard in accordance with claim 4 wherein said triangular subassembly has stabilizer feet located contiguous to the apexes of said triangular subassembly.

6. A play yard in accordance with claim 5 wherein each stabilizer foot is disposed beyond a plane intersecting the vertical axes of a pair of vertical post members which are located adjacent a stabilizer foot.

7. A play yard in accordance with claim 4 wherein each of said rail members is curved outwardly.

8. A play yard in accordance with claim 4 wherein said vertical post member includes a cap assembly disposed over the top of said post member to enclose said pivotal connection between said post and rail members.

9. A play yard in accordance with claim 4 wherein said triangular subassembly comprises an equilateral triangle.

10. A play yard in accordance with claim 5 wherein a vertical post is substantially equally spaced from adjacent stabilizer feet.

11. A play yard in accordance with claim 4 and further including a panel assembly comprising three side panels, each side panel extending from said top assembly to said bottom assembly when said play yard is in an erected position; and, a bottom panel joined to said panels and adapted to seat on said bottom assembly.

12. A play yard in accordance with claim 11 and further including a removable base insert configured to have a triangular shape, said insert being disposed within said panel assembly adjacent said bottom panel.

13. A play yard in accordance with claim 12 wherein said base insert is formed of a plurality of discrete foldable sections wherein said sections are adapted to wrap about said play yard when said play yard is in a collapsed position.

14. A play yard in accordance with claim 11 wherein said bottom panel includes upper and lower surfaces and said subassembly legs are attached to the lower surface of said bottom panel.

15. A play yard in accordance with claim 12 wherein said upper surface of said bottom panel includes means for pulling on and collapsing said subassembly legs.

16. A play yard in accordance with claim 4 further including a plurality of base insert stops located on said subassembly.

17. A play yard in accordance with claim 16 wherein said subassembly includes a plurality of pedestals and said base insert stop members are located on said pedestals.

18. A play yard in accordance with claim 5 wherein said stabilizer feet each lie at the location of a plane intersecting the vertical axes of vertical posts adjacent a stabilizer foot.

19. A play yard in accordance with claim 5 wherein said stabilizer feet lie at least at the edge of the outer periphery of the top assembly or bottom assembly, whichever is larger.

20. A play yard in accordance with claim 19 wherein said stabilizer feet lie beyond the outer periphery of the top assembly or bottom assembly, whichever is larger.

21. A play yard comprising:

a plurality of vertical posts;

a collapsible top assembly connected to said posts;

a collapsible bottom assembly connected to said posts, said bottom assembly comprising a collapsible subassembly; and, a pair of post connecting members connected with each vertical post, each pair having one member end connected to a vertical post and a second member end connected to said subassembly to form truss segments associated with each post of said play yard, said subassembly and said post connecting members being substantially coplanar when the play yard is erected.

22. A play yard as defined in claim 21 wherein the play yard is triangular.

23. A play yard as defined in claim 21 further comprising stabilizer feet coupled to the bottom assembly.

24. A play yard as defined in claim 23 wherein each of the stabilizer feet is located between adjacent ones of the vertical posts and each stabilizer foot is spaced outward from a plane intersecting the corresponding adjacent posts.

25. A play yard as defined in claim 21 wherein the top assembly comprises a plurality of collapsible rail assemblies.

26. A play yard as defined in claim 25 wherein each rail assembly comprises first and second rail members connected at a collapsible locking rail joint.

27. A play yard comprising:

a collapsible top assembly;

a plurality of vertical posts for supporting the play yard on a surface, each vertical post having a top end and a bottom end, said top assembly being connected to said vertical posts near the top ends;

a collapsible bottom assembly comprising a truss formed of a plurality of truss segments, said bottom assembly being connected to said vertical posts near the bottom ends; and, a plurality of spaced stabilizer feet attached to said truss, each of said stabilizer feet being located substantially equidistant between adjacent vertical posts and being spaced outwardly from a line connecting the corresponding adjacent posts, in a direction away from a central portion of the top assembly.

* * * * *

UNITED STATES PATENT AND TRADEMARK OFFICE

CERTIFICATE OF CORRECTION

PATENT NO. : 5,826,285

DATED : October 27, 1998

INVENTOR(S) : Mariol et al.

It is certified that error appears in the above-identified patent and that said Letters Patent is hereby corrected as shown below:

Column 8, line 5: after "...play yard," please delete -- 25 --.

Signed and Sealed this

Second Day of March, 1999

*Attest:*

Q. TODD DICKINSON

*Attesting Officer*

*Acting Commissioner of Patents and Trademarks*